United States Patent [19]

Orsinger et al.

[11] Patent Number: 5,042,232

[45] Date of Patent: Aug. 27, 1991

[54] IN-LINE ROTARY INSERTER

[75] Inventors: Winston A. Orsinger, Nazareth; Richard B. Hawkes, Bethlehem; Eric A. Belec, Kempton, all of Pa.; James S. Lee, Jr., Phillipsburg, N.J.; Harry C. Noll, Jr., Whitehall, Pa.; David P. Nyffenegger, Bethlehem, Pa.; George Fallos, Easton, Pa.

[73] Assignee: Bell & Howell Phillipsburg Co., Skokie, Ill.

[21] Appl. No.: 506,022

[22] Filed: Apr. 9, 1990

Related U.S. Application Data

[63] Continuation-in-part of Ser. No. 338,171, Apr. 14, 1989, Pat. No. 5,029,832.

[51] Int. Cl.[5] ..... B65B 43/26

[52] U.S. Cl. ..... 53/460; 53/284.3; 53/493

[58] Field of Search ..... 53/266 A, 206, 569, 53/460, 392, 391, 69, 64, 493, 266.1, 284.3

[56] References Cited

U.S. PATENT DOCUMENTS

| | | | |
|---|---|---|---|
| 2,621,039 | 12/1952 | Kleineberg et al. | 270/54 |
| 2,763,110 | 9/1956 | Stuart | 53/392 X |
| 3,015,926 | 1/1962 | Galambos | 53/266 A X |
| 3,410,053 | 11/1968 | Bonsch | 53/266 A X |
| 3,423,900 | 1/1969 | Orsinger | 53/266 A |
| 3,593,486 | 7/1971 | Helm | 53/206 X |
| 3,825,247 | 7/1974 | Fernandez-Rana et al. | 270/58 |
| 3,911,862 | 10/1975 | Lupkas | 118/7 |
| 4,043,551 | 8/1977 | Morrison et al. | 271/243 |
| 4,079,576 | 3/1978 | Morrison et al. | 53/266 A |
| 4,177,979 | 12/1979 | Orsinger et al. | 270/54 |
| 4,299,073 | 11/1981 | Golicz et al. | 53/493 |
| 4,649,691 | 2/1987 | Buckholz | 53/53 |
| 4,674,258 | 6/1987 | Ehlscheid et al. | 53/154 |
| 4,712,359 | 12/1987 | Depasquale et al. | 53/460 |
| 4,741,147 | 3/1988 | Noll | 53/505 |
| 4,781,013 | 11/1988 | Depasquale et al. | 53/569 |
| 4,798,040 | 1/1989 | Haas et al. | 53/460 |
| 4,805,382 | 2/1989 | Depasquale et al. | 53/520 |
| 4,805,384 | 2/1989 | Depasquale et al. | 53/569 |
| 4,817,368 | 4/1989 | Depasquale et al. | 53/460 |
| 4,944,136 | 7/1990 | Gough | 53/493 |

FOREIGN PATENT DOCUMENTS

| | | |
|---|---|---|
| 0102700 | 3/1984 | European Pat. Off. . |
| 2543491 | 3/1984 | France . |
| 1237873 | 6/1971 | United Kingdom . |
| 1567603 | 5/1980 | United Kingdom . |

*Primary Examiner*—James F. Coan

*Attorney, Agent, or Firm*—Griffin Branigan & Butler

[57] ABSTRACT

An in-line rotary inserter device comprises an envelope feed station (30) and insert feeding modules (20,22,24,26), an inserting station (32), a sealing and stacking assembly (38,40,42), and various diverters (33,36,56). The envelope feed station (30) withdraws envelopes from a hopper-held envelope stack )66,94) and conveys them to the inserting station (32). Each insert feeding module comprises a hopper-held insert stack disposed above, along, and in line with an insert conveyor (34). The conveyor, along its track, carries inserts dispensed from the hopper-held insert stacks to the inserting station (32). Diverter stations for diversion of envelopes and inserts in various locations along their feed paths are provided for normal operational purposes and for rectification of sensed fault conditions. Subsequently to inserting, insert-filled envelopes are conveyed from the inserting station (32), are sealed, turned, stacked, and processed through operations that are customary in preparation of mailable items. Supervision and coordination of operation of the various assemblies and stations in concert is provided by computer control (50).

21 Claims, 18 Drawing Sheets

IN-LINE ROTARY INSERTER

This is a continuation-in-part of application Ser. No. 338,171, filed Apr. 14, 1989, now U.S. Pat. No. 5,029,832.

1. Field of the Invention:

This invention relates to apparatus and method for handling high volume mail and, in particular, it relates to in-line rotary inserter devices having a plurality of hopper-held insert feeding assemblies positioned along conveyors to dispense inserts onto the conveyors, and having devices for stuffing envelopes with the inserts.

2. Prior Art and Other Considerations:

Many present devices for stuffing inserts into envelopes employ conveyors to convey stack-dispensed inserts to an envelope stuffing device. Multiple inserter devices rely on a plurality of hoppers disposed along conveyors and dispensing inserts onto the conveyor in predetermined manner to achieve collated insert packages that are subsequently inserted into envelopes.

Such equipment is required to operate at increasingly higher celerities with high reliability and shortest possible down-times. Many problems, which either do not exist or which are inconsequential in low-speed operation, need to be overcome in high-speed operation. For instance, such problems involve frictional, inertial, and other speed-related effects of moving apparatus components and of handled document materials.

Prior art inserter devices include U.S. Pat. Nos. 4,043,551 and 4,079,576 to Morrison et al, U.S. Pat. No. 4,177,979 to Orsinger et al, U.S. Pat. No. 4,649,691 to Buckholz, U.S. Pat. No. 3,825,247 to Fernandez-Rana et al, U.S. Pat. No. 3,423,900 to Orsinger, U.S. Pat. No. 2,621,039 to Kleineberg et al, and U.S. Pat. No. 3,809,385 to Rana.

It is an important feature of the present invention to provide apparatus and method for automatically inserting into envelopes at high celerities a plurality of inserts in predetermined and preprogrammed continuous manner and to further automatically process such insert-filled envelopes through diverting, flap-sealing, turnover, stacking, and other operations associated therewith, substantially under computer control and supervision, while providing higher production rates than heretofore practically feasible.

SUMMARY OF THE INVENTION

U.S. Pat. No. 4,177,979 (Orsinger et al), entitled "Signature Gathering Machine", and commonly assigned herewith, is incorporated herein be reference.

In accordance with principles of the present invention, envelopes are conveyed from a hopper to an inserting station, where envelopes are opened and inserts are inserted therein. The inserts are furnished by a plurality of modular insert hoppers which are positioned in line above an endless insert conveyor of the pusher pin type. Envelopes having inserts inserted therein are transported to a vacuum-belt transporter/diverter unit and are directed and transported thereby along at least one path that includes a turn-over module, a sealing module, and an on-edge stacking unit.

The inserter apparatus operates under preprogrammable computer control and supervision. Automatic error handling and visual display of operational status and program information are provided.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference numerals refer to like parts throughout different views. The drawings are schematic and not necessarily to scale, emphasis instead being placed upon illustrating principles of the invention.

FIG. 5 is a schematic partial enlargement of a middle portion of the view in FIG. 13, showing additional details.

DESCRIPTION OF THE PREFERRED EMBODIMENTS

Figure 1:
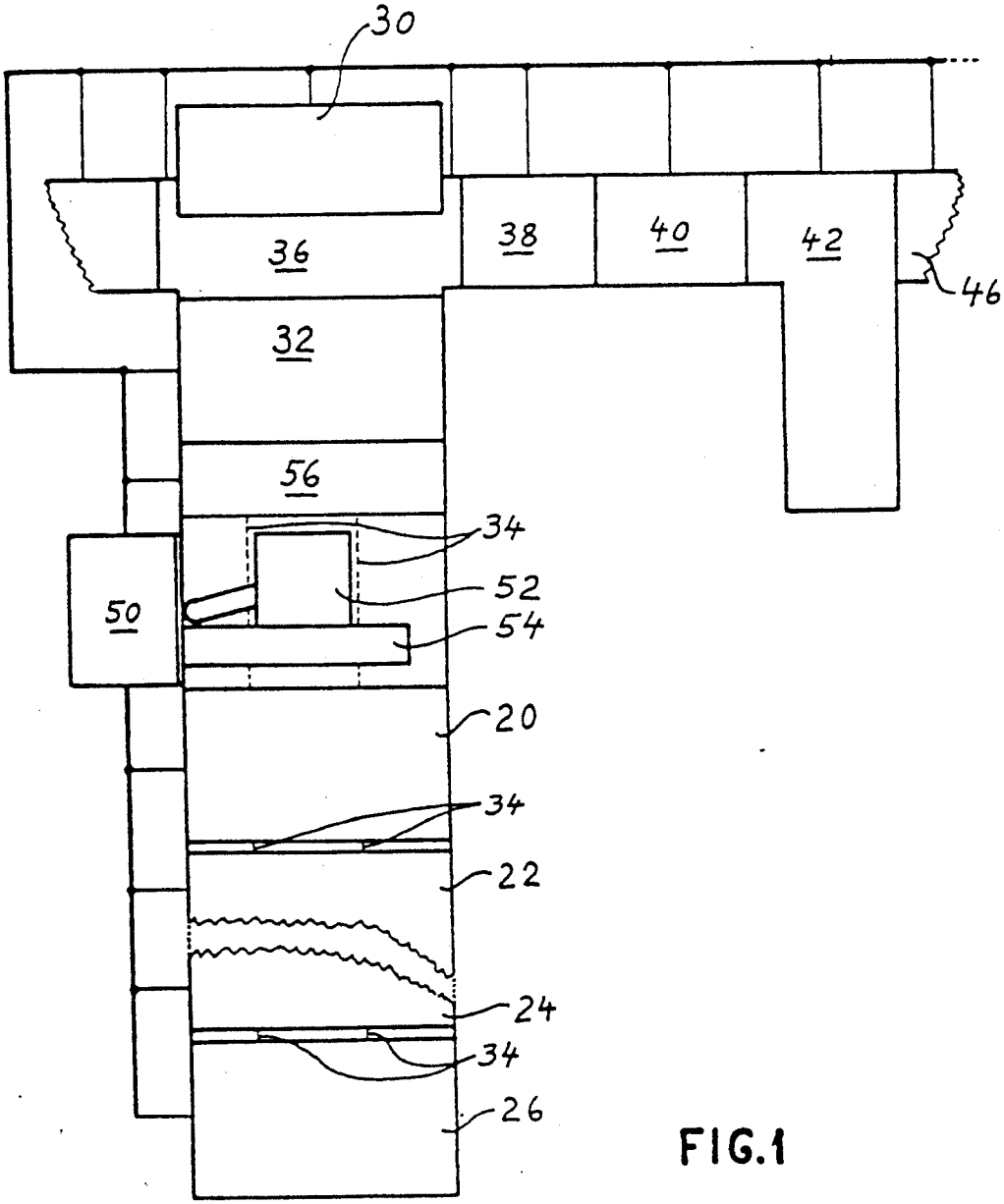
FIG. 1 is a schematic diagrammatic plan view of a preferred embodiment of an in-line rotary inserter apparatus according to the present invention.

An embodiment of the in-line rotary inserter apparatus is shown in FIG. 1 and comprises basically the following subsystems: One or more rotary insert feeder modules 20, 22, 24, 26 for furnishing inserts from insert hoppers, each including an insert thickness detector; an envelope feed station 30 for furnishing envelopes from an envelope hopper; an inserting station 32 in which envelopes are inserted with inserts that are collated and conveyed thereto upon a pin conveyor 34 (from insert feeder modules); and, a vacuum belt transporter/diverter unit 36 for transport and selective diversion of inserted envelopes.

The vacuum belt transporter/diverter unit 36 can provide selective diversion and transport to one of two paths. At least one path comprises an envelope turnover module and an envelope sealing module. The other path can be used for alternate delivery of incompletely inserted (faulty) envelopes, buckled envelopes, and the like; or it can be used for selective alternate delivery of unsealed envelopes for further handling. Turnover module and sealing module can be arranged in either order, provided that each is structured accordingly.

Figure 1A:
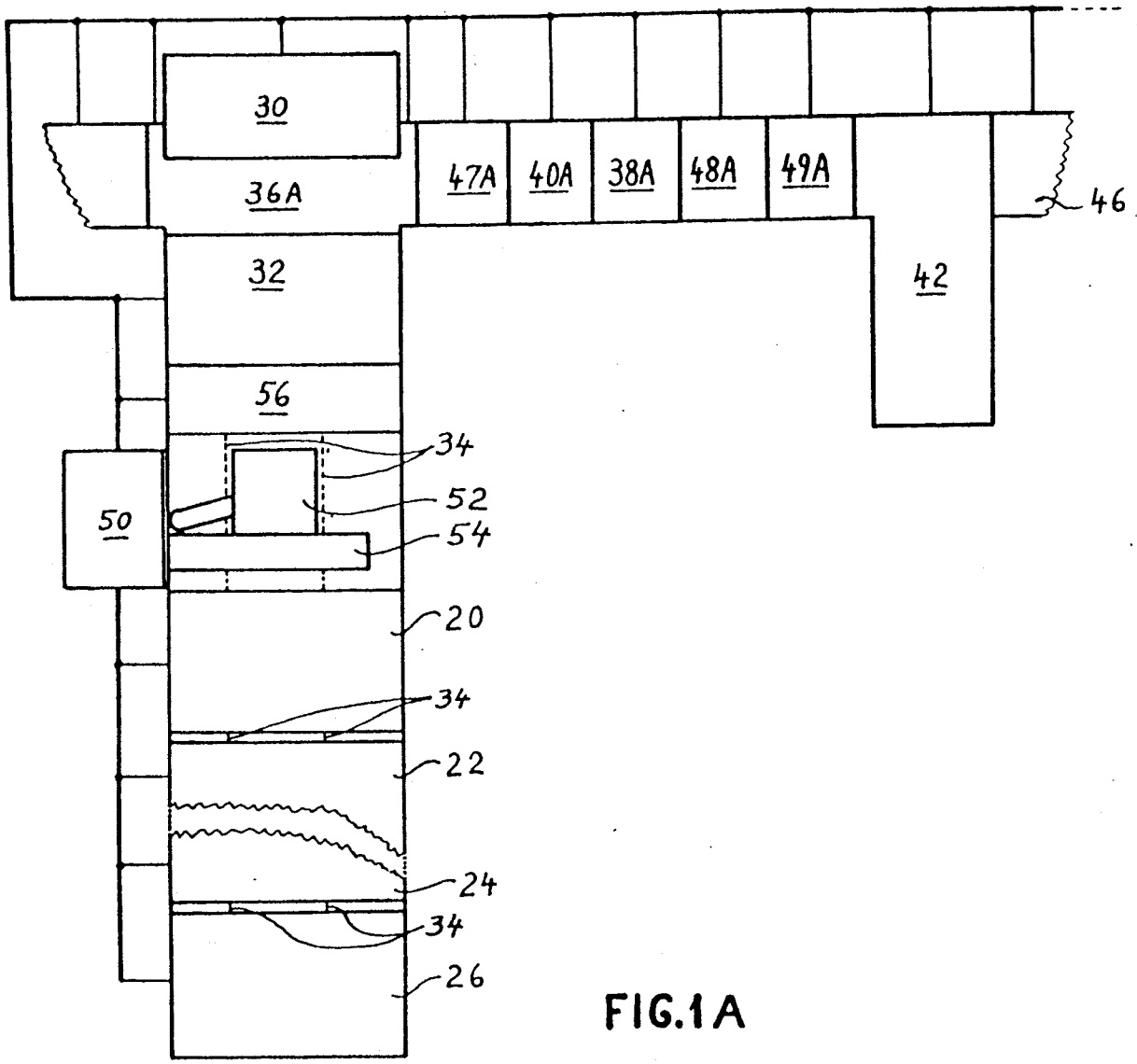
FIG. 1A is a schematic diagrammatic plan view of another preferred embodiment of an apparatus of the present invention.

For instance, the embodiment shown in FIG. 1 provides first for sealing of envelopes delivered from vacuum belt transport/diverter unit 36 to sealing module 38. Sealed envelopes are thereafter delivered to turnover module 40, are turned over therein to flap-down orientation, and are farther conveyed to on-edge stacking/diverter unit 42. The embodiment shown in FIG. 1A provides first for turnover of unsealed envelopes in a turnover module 40A which delivers turned over envelopes to a sealing module 38A.

The embodiment of the inline rotary inserter apparatus shown in FIG. 1 further comprises an on-edge stacking/diverter unit 42 that receives envelopes and stacks them on edge in an accumulator 44 or passes envelopes on to additional handling equipment 46.

The inserter apparatus shown in FIG. 1 further comprises a main computer 50 for operational control, supervision, and coordination of individual units and modules interconnected therewith, a display/control console 52 to display operational information and receive operator input commands, a skew detector arrangement 54 for sensing of misalignments of collated inserts being conveyed to inserting station 32, and an insert diverter 56 for diversion of inserts (for instance in case of errors in, damage to, or misalignments of inserts). Not specifically shown in FIG. 1 is an envelope diverter 33 (FIG. 2) which is provided in a location between envelope feed station 30 and inserting station 32. Envelope diverter 33 is disposed in a lower equipment region (below pin conveyor 34) along the envelope feed path for selective interception of envelopes that have been stigmatized as being faulty. As specific inserts are intended to be inserted into specific envelopes (and are associated therewith), selective diversion of inserts by insert diverter 56 in case of the occurence of insert fault conditions is associated with interception and diversion of corresponding envelopes in envelope diverter 33 and vice versa. Thusly, if further inserts or associated envelopes are stigmatized as faulty or otherwise desired to be diverted, the corresponding associated envelopes or inserts, respectively, are also diverted in order to avoid empty envelopes or inserts without envelopes being processed and conveyed farther. Therefore, envelope diverter 33 also serves to selectively divert (under preprogrammed computer control of computer 50) those envelopes for whom intended associated inserts are being diverted by insert diverter 56.

Overall operation of in-line inserter apparatus is described in U.S. Pat. No. 4,079,576 to Wilber J. Morrisson et al., commonly assigned herewith, and the respective material in that patent is hereby incorporated by reference herein.

Figure 2:
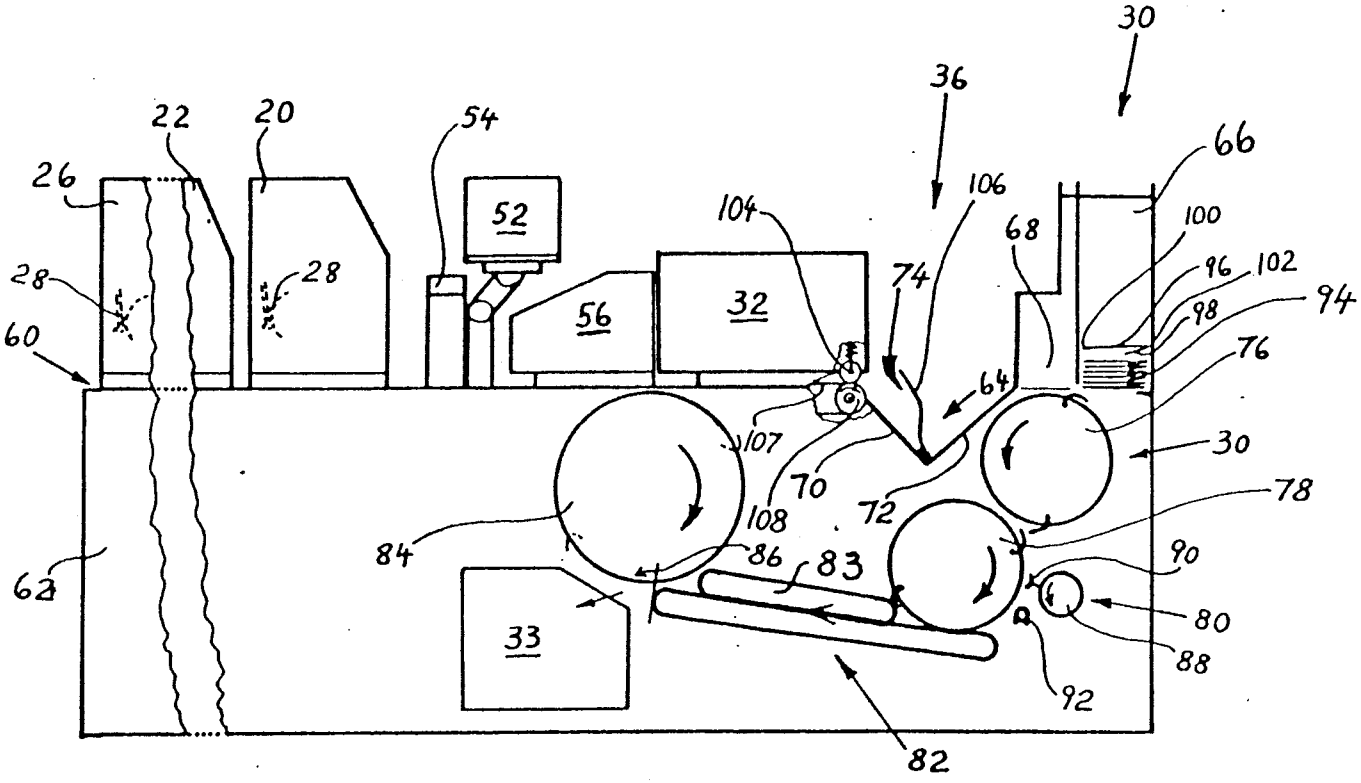
FIG. 2 is a schematic fragmental side elevational view of a main portion of the apparatus shown in FIG. 1.

Referring now also to FIG. 2, a main track bed 650 is horizontally disposed in the upper portion of a main base 62. Main track bed 60 carries, in its upper portion, pin conveyor 34 for receiving in collated manner inserts from insert feeder modules 20, 22, 24, and 26, and for transporting (from left to right) such inserts past skew detector arrangement 54 and insert diverter 56 to inserting station 32. Display/control console 52 is shown adjustably mounted above main track bed 60. Insert feeder modules (20, 22, 24, 26), skew detector 54, insert diverter 56, and inserting station 32 are generally disposed above main track bed 60 in cantilevered bridging manner.

Figure 2A:
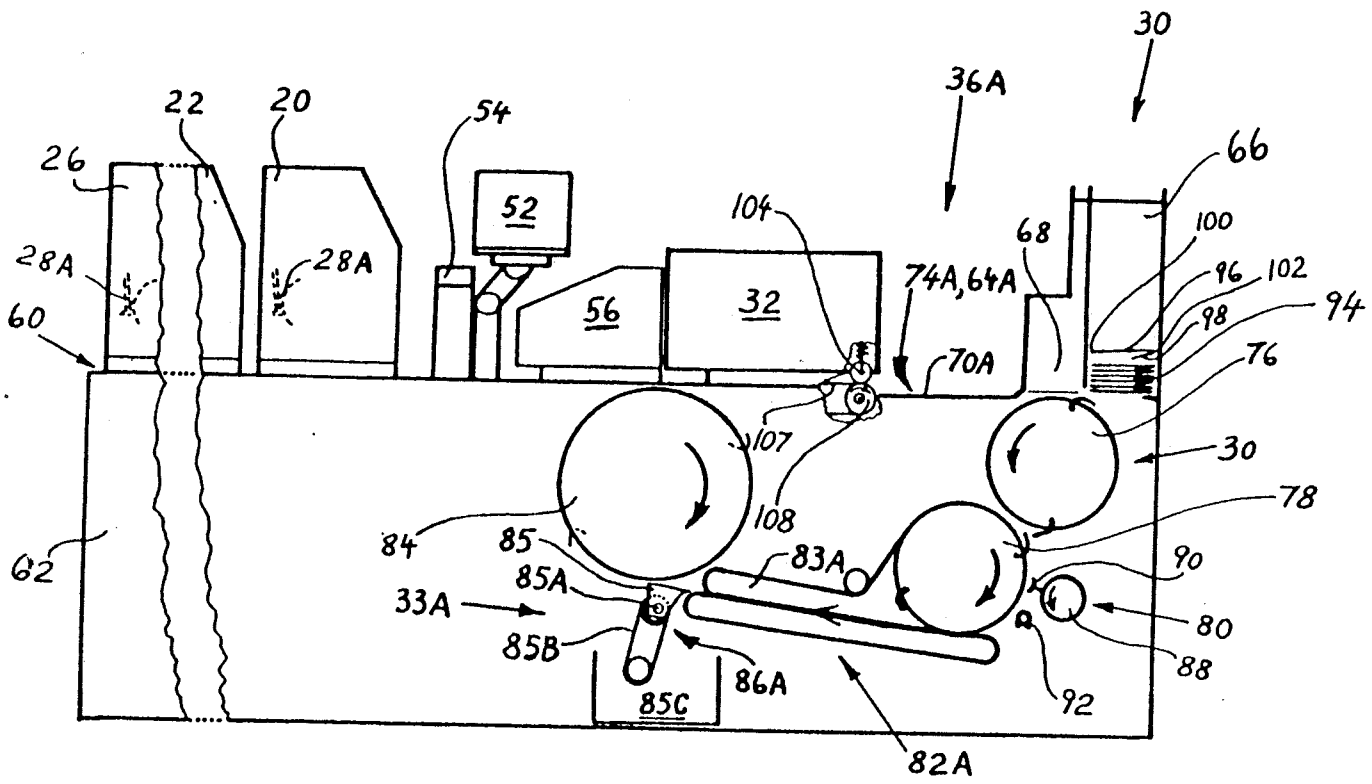
FIG. 2A is a schematic fragmental side elevational view of a main portion of the apparatus shown in FIG. 1A.

Envelope feed station 30 is disposed on and within main base 62 at the end thereof that is opposite to the end which carries insert feeder modules 20, 22, 24, 26. The upper portion of envelope feed station 30 includes an envelope hopper 66 and a hopper mechanism 68. A transverse pass 64, including first and second sloping walls 70 and 72, is disposed in upper portion of main base 62 between inserting station 32 and hopper mechanism 68. A fall region 74 is disposed in transverse pass 64. Another embodiment of the inserter apparatus is shown in FIG. 2A to comprise a transverse pass 64A having a substantially horizontal surface 70A with a short fall region 74A thereabove, as will be described in detail later in conjunction with FIG. 2A.

Envelope feed station 30 comprises envelope hopper 66, hopper mechanism 68 for withdrawing of envelopes from hopper 66 and for feeding of envelopes to a first gripper drum 76, a second gripper drum 78 for transporting envelopes conveyed thereto by first gripper drum 76, a flap envelope 80 to open envelope flaps of envelopes transported by second gripper drum 78, and an envelope conveyor device 82, including an adjustable upper belt device 83, for conveying of envelopes from second gripper drum 78 to a vacuum gripper drum 84. Gripper drums 76 and 78 (and their operation) are of generally conventional kind. Envelope diverter 33 is disposed proximate to the delivery end of envelope conveyor device 82 to selectively intercept and divert envelope rejects into a reject catch bin. Vacuum gripper drum 84 delivers envelopes onto main track bed 60 in readiness for inserting with inserts in inserting station 32.

Flap opener 80 comprises a rotating rotor 88, having a rotary valve arrangement associated therewith for valving of vacuum to one or more sucker cups 90. Sucker cup 90 is disposed upon the periphery of rotor 88 whose rotation (and valving of vacuum to sucker cup 90) is synchronized and properly phased with the rotation of second gripper drum 76, so that the flap of an envelope transported by second gripper drum 76 past flap opener 80 is momentarily grabbed and opened (unfolded) by sucker cup 90. A plow/sensor device 92 is disposed just downstream from flap opener 80 and intercepts an opened flap and further bends in into the unfolded position as the envelope is transported by and upon second gripper drum 78. Plow/sensor device 82 is equipped with a photo-sensor to check correct flap opening and to detect if an envelope is missing at the time it should be present.

Envelope hopper 66 contains an envelope stack 94. Envelopes are stacked therein in an orientation as indicated by a typical stacked envelope 96 having a leading edge 100, a trailing edge 102, and an envelope flap 98 folded along trailing edge 102 onto its lower face. Consequently, withdrawal of an envelope from the bottom of stack 94 onto first gripper drum 76 is performed in an attitude and a direction that precludes catching of the flap on the next envelope. Transport of the withdrawn envelope by first gripper drum 76 to second gripper drum 78 results in an orientation of the envelope (upon second gripper drum 78), as it passes by flap opener 80, having unopened flap 98 facing toward flap opener 80. At this time, sucker cup 90 grabs envelope flap 98 by vacuum action and hinges it about trailing edge 102 into an open position during passage of the envelope. Opened flap 98 is thereupon intercepted by plow/sensor device 92 and thereby further unfolded, whilst sucker cup 90 releases as its vacuum is vented and valved off in accordance with the operation of the rotary valving arrangement of rotor 88.

Subsequently, an envelope is delivered and released onto envelope conveyor device 82. Envelope conveyor device 82 comprises two driven endless belts that nip therebetween an envelope delivered thereto and that convey it to vacuum gripper drum 84. A typical envelope will be continuously transported from conveyor device 82 to vacuum gripper drum 84.

The two driven belts (comprised in conveyor device 82) are arranged in such a manner as to permit slippage of an envelope with respect to the belt motion if an envelope is stopped by a selectively interposable stop gate 86. Upper belt device 83 is adjustably mounted for this purpose and for accommodation of different thickness envelopes. If an envelope is intended to be diverted, it is stopped by stop gate 86 until it can no longer be gripped by the next grippers (of vacuum gripper drum 84) passing by. Stop gate 86 is moved out of the way of the envelope path at such time and the envelope will be driven by the belts into a reject bin located in envelope diverter 33.

In an alternate embodiment, stop gate 86 is interposed into the path of each envelope to register the envelope in position. Stop gate 86 is moved out of the way to release the envelope at the appropriate instant in time to be gripped by the grippers of vacuum gripper drum 84. To reject and divert an envelope, stop gate 86 is moved out of the way at a time when the envelope can miss and bypass the grippers of the vacuum gripper drum 84, so that the envelope is delivered into the reject envelope bin.

Envelopes delivered onto main track bed 60 are positioned by vacuum gripper drum 84 for the inserting operation in inserting station 32. Following the inserting operation, envelopes are delivered from the inserting station 32 through a nip between a spring-loaded pressure roller arrangement 104 and a driven conveyor belt arrangement 107 that rides about a pulley arrangement 108. Envelopes are delivered into fall region 74 in the same orientation as received; i.e. with leading edge 100 leading and envelope flap 98 trailing. The envelope falling into fall region 74 is guided by a deflector bar 106 so that it settles against first sloping wall 70 of vacuum belt transporter/diverter unit 36.

Figure 3:
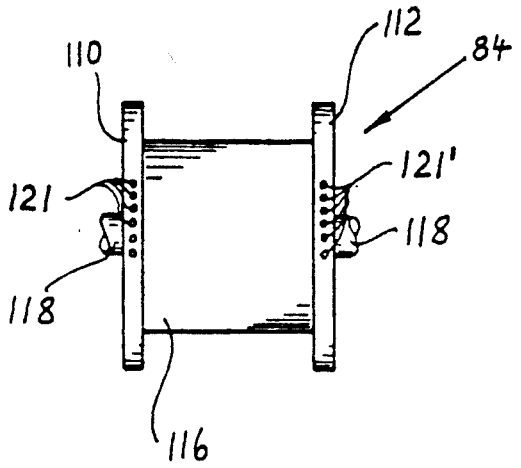
FIG. 3 is a schematic partial detail view of a vacuum gripper drum shown in FIGS. 2 and 2A.

Referring now to FIG. 3, continuously revolving vacuum gripper drum 84 schematically depicted therein comprises a first and a second face disc 110 and 112 mounted on a drum 116, which in turn is rotatably supported upon a drum axle 118 in accordance with conventional practise. Various mechanisms (not shown here) are included in this assembly in conventional manner to perform the required customary gripper functions.

Face discs 110 and 112 are provided with a plurality of vacuum holes 121 and 121' open to the discs' peripheries. Vacuum holes 121 and 121' are disposed about the disc peripheries in a plurality of groups, whereby each group is disposed in a predetermined relationship to the drum gripper mechanism in positions corresponding to locations whereupon envelopes are carried. Vacuum is automatically valved to each group before an envelope is released by respective grippers on the gripper drum 84. Consequently, an envelope released by grippers remains held to vacuum gripper drum 84 upon vacuum holes 121 and 121' until it is properly delivered to its substantially horizontal registered position on main track bed 60.

Figure 3A:
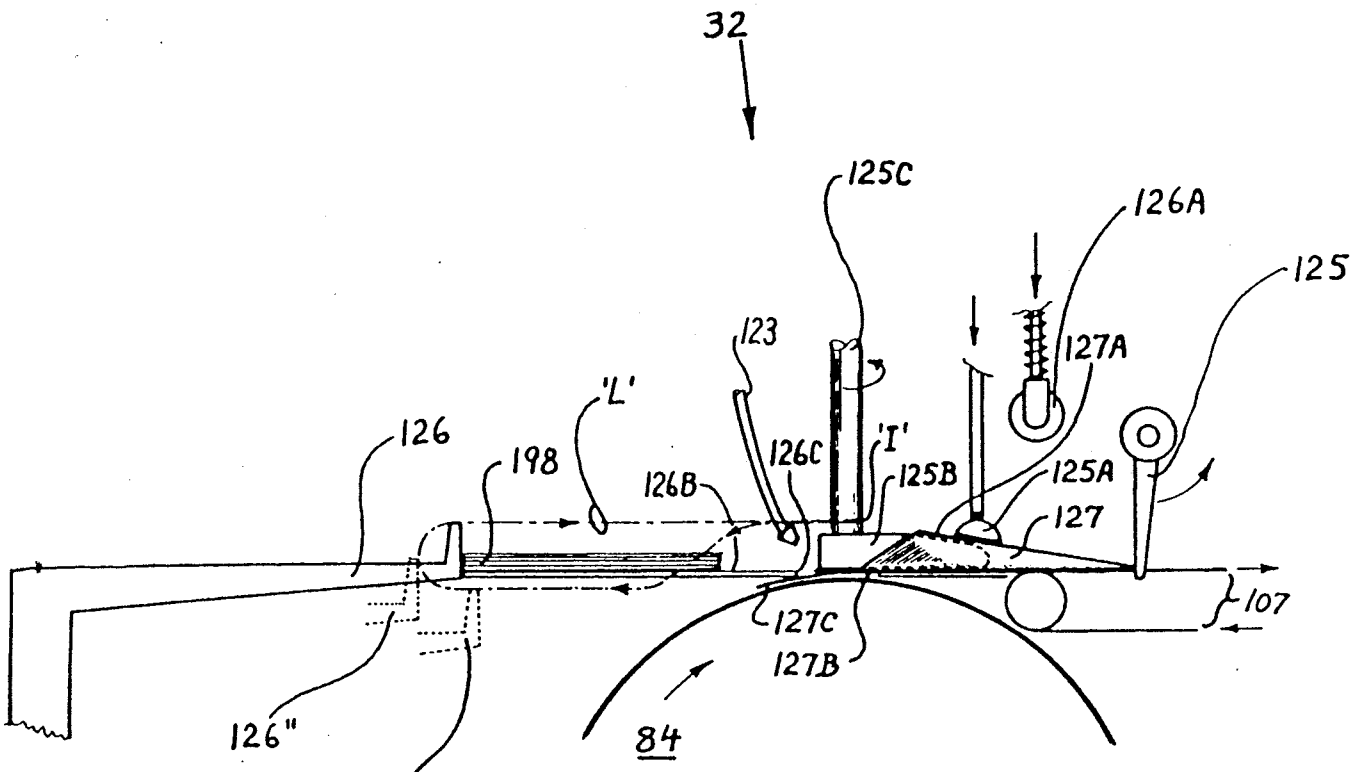
FIG. 3A is a schematic fragmental side elevational detail view of portions of the inserter mechanism of the apparatus, for instance as indicated in FIGS. 2 and 2A.

Referring now to FIG. 3A, a fragmented portion of the inserter mechanism of inserting station 32 (FIGS. 1 and 2) is shown therein. The various components are disposed in mutual positional relationships representative of an early stage of the inserting operation. FIG. 3A depicts pertinent components disposed in the lower region of inserting station 32 as well as components particularly involved and associated with the inserting operation that are disposed on, in, and beneath the main track bed 60 (FIG. 2). The view of FIG. 3A represents a region located approximately in the middle of FIG. 2 in enlarged form and includes details that have been omitted from FIG. 2 for the sake of clarity.

An upper portion of vacuum gripper drum 84 (FIG. 3) is shown here comprised in inserting station 32. Further comprised in inserting station 32 are stop fingers 125, suction cups 125A, a pair of opening fingers 125B mounted on revolvable shafts 125C, insert pushers 126, and spring-loaded drop rollers 126A. A horizontally disposed top plate 126B having a trailing end 126C is partially shown. Also indicated here is a leading portion of conveyor belt arrangement 107. An envelope 127 is shown disposed substantially horizontally in a registered position to which it has been delivered by vacuum gripper drum 84. Envelope 127 has a top side 127A, a bottom side 127B, and a flap 127C. Flap 127C is held open in a slightly downward directed orientation by and below trailing end 126C of top plate 126B.

An air nozzle 123 directs a timed blast of compressed air flow over the upper surface of flap 127C into the envelope to assist opening of the envelope prior to the insertion operation. Air flow is valved on an an envelope is delivered to its insertion position. The air flow also serves to force the envelope against its positional registration stops, for instance against stop fingers 125, and aids in holding the envelope downwardly. Air flow is shut off once the insertion operation has begun. Also shown here is an insert stack package 198 disposed upon top plate 126B and being propelled by insert pushers 126 toward the right for insertion into envelope 127. Positional registration stops can alternately be provided in form of stop fingers which are raised from beneath the upper surface of conveyor belt arrangement 107 in appropriately times manner.

The travel motion of the uppermost tips of insert pushers 126 in the course of a complete insertion cycle of indicated by phantom lines as locus pattern 'L'. Locus patter 'L' follows approximately an horizontally elongated noose-shaped form. Insert pushers 126 are translated in a vertical plane along locus pattern 'L' without changing angular orientation during the travel motion of an insert cycle. Insert pusher 126 is shown in a position during the beginning of an insertion cycle. Other salient positions are also indicated by dotted lines by pusher position 126', representing a low position near the end of the retraction portion of an insertion cycle, and by pusher position 126", representing the end of the retraction portion and the early beginning of the insertion portion of an insertion cycle. The apex of the travel motion of insert pusher 126 at the point of travel direction reversal on the right end of locus pattern 'L' is designated as insertion end 'I'.

It should be recognized that a plurality of identical components are usually present in appropriately parallel positions perpendicularly to the plane of the depiction in front of or behind each such component, as is customary in mail handling equipment. For example, there is a plurality of stop fingers 125, suction cups 125A, insert pushers 126, drop rollers 126A, etc. Moreover, the depiction omits obstructing components that could be detrimental to clarity of understanding.

As hereinbefore described, vacuum gripper drum 84 conveys envelopes in a clockwise direction upwardly to a horizontal position, as indicated by envelope 127 in FIG. 3A. Envelope 127 is delivered to this position through a gap between trailing end 126C (of top plate 126B) and the periphery of vacuum gripper drum 84 onto an inserting station surface. At this time, opening fingers 125B have orientations that are approximately 80 degrees from their shown orientation so that their tips substantially point toward one another. The envelope is stopped when its leading edge is intercepted by stop fingers 125. Stop fingers 125 are automatically rotated into the position shown to stop an envelope, and are rotated out of this position to release an envelope for farther transport by conveyor belt arrangement 107.

As an envelope has been delivered to the insertion position shown, and air flow into the envelope from nozzle 123 has been initiated, suction cups 125A descend and, having vacuum valved thereto, attach to top side 127A. Suction cups are then lifted up, lift the envelope's top side 127A and the envelope forms an open pocket.

Opening fingers 125B are now rotated by their shafts 125C (one finger clockwise and the other one anticlockwise) by approximately 80 degrees into the orientation indicated, so that their tips slide into the opened pocket of the envelope; i.e. beneath top side 127A. This finger position and orientation is now substantially along and parallel to the internal side edges of the opened envelope. Opening fingers 125B have a substantially rectangular or square C-channel-shaped thin-walled cross-section, whereby the C-channel is disposed with a side wall facing downwardly and its open side facing toward the middle of envelope 127 in the orientation shown in order to reliably guide insert stack package 198 into envelope 127 during the subsequent insertion operation. For the latter purpose, opening fingers are customarily also provided with ramp-like leading edges. As indicated, the height of fingers 125B is somewhat reduced in direction toward their tips and their tips are smoothed and slightly rounded off to avoid sharp edges that might catch on the envelope during finger rotation therein and on inserts during insertion thereof.

Envelope 127 has now been readied for insertion, as hereinabove described, and insert pushers 126, that have risen from beneath top plate 126B and that have intercepted insert package 198 along its trailing edge, move horizontally toward the right and push insert stack package 198 between opening fingers 125B into envelope 127. As indicated by insertion end 'I' of locus pattern 'L', insert pushers 126 push insert stack package 198 to a position vicinal to the hinge line of the envelope flap 127C. Thereafter, insert pushers 126 retract along locus pattern 'L', as indicated by arrows thereupon. Vacuum to suction cups 125A is vented and valved off by now and drop rollers 126A descend into the insert-filled envelope 127 and nip it in spring-loaded manner onto driven conveyor belt arrangement 107, whilst stop fingers 125 are pivoted out of the way of the envelope. Other drop rollers can be provided and moved downwardly to nip the envelope in other appropriate locations along the envelope.

Envelope 127 is frictionally engaged by conveyor belt arrangement 107, withdraws from opening fingers 125B, and is propelled toward the right. Fingers 125B are thereafter rotated approximately by 80 degrees back to the orientation with tips pointing substantially toward one another. The insert-filled envelope is delivered into fall region 74 (FIG. 2).

The translational motion of insert pushers specifically along locus pattern 'L' is provided in order to achieve two main objectives; the horizontal straight-line inserting motion and the rearward and simultaneously downwardly curved retraction motion. Insert stack packages, being conveyed by pin conveyor 34 (FIG. 1) in main track bed 60 along main base 62 by pusher pins 196 (FIG. 7), are seriatim transported to the approximate region indicated in the location of insert stack package 198 disposed upon top plates 126B in FIG. 3A.

Insert pushers 126 must be moved out of the way of a next insert stack package being conveyed to this region and are, therefore, disposed beneath top plates 126B at that time, as indicated by locus pattern 'L' and, for instance, insert positions 126' and 126" therealong. Thereafter, insert pushers 126 are translated upwardly and eventually toward the right, so that they are raised through gaps between top plates 126B, engage the trailing edge of insert stack package 198, and push it horizontally to the right into envelope 127, as hereinbefore described.

Once insert package 198 is inserted in envelope 127, insert pushers retract from insertion end 'I' and gradually sink downwardly beneath top plates 126B along the path indicated by locus pattern 'L'. This rearward and downward retraction, however, must not interfere with the next envelope being delivered upon vacuum gripper drum 84 in clockwise direction upwardly. This is an important reason for the downwardly curved path with fast downward and rearward retraction of insert pushers 126, while simultaneously allowing clearance for delivery of the next envelope and, also simultaneously, permitting an early downward retraction of insert pushers to provide clearance for delivery of the next insert stack package. Travel distances and spacings between successive insert packages are thusly kept to a minimum.

The described translational motion of insert pushers 126 is provided by a drive mechanism that comprises a trolley upon which insert pushers are mounted. The trolley is free to travel horizontally upon a trolley bar arrangement which is cam-driven vertically up and down. The horizontal motion of the trolley is provided by an endless chain drive. Appropriate dimensional and phase relationships between these trolley drive arrangements achieve the locus pattern 'L'.

Figure 3B:
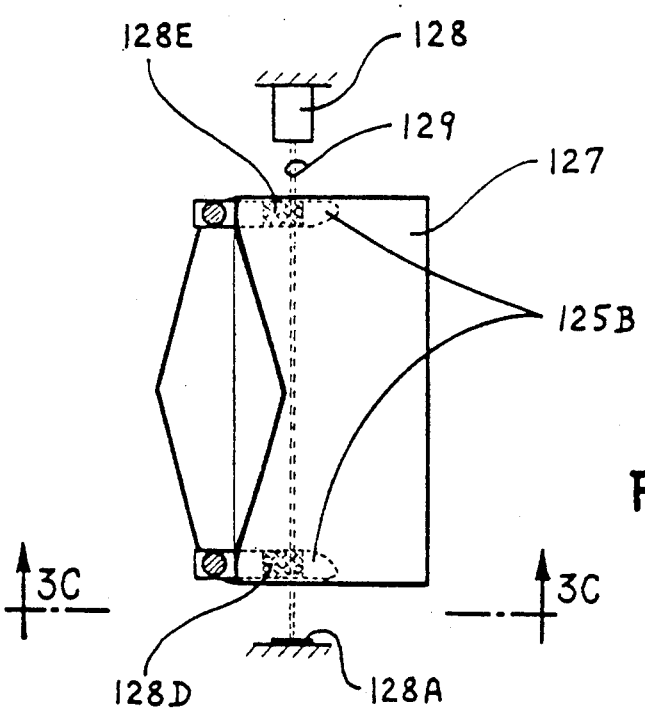
FIG. 3B is a schematic top view of a partial detail of an insertion jam detection arrangement according to an embodiment of the invention.
Figure 3C:
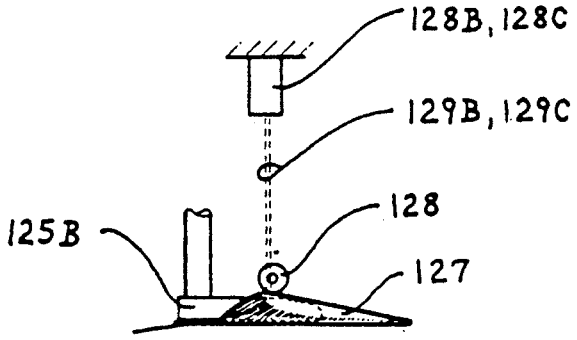
FIG. 3C is a schematic side view of a partial detail of the insertion jam detection arrangement of FIG. 3B.

Referring now to FIGS. 3B and 3C, an insertion jam detection arrangement, that is schematically depicted therein and that is disposed in inserting station 32 (FIGS. 1, 2, and 3A), comprises a horizontal and a vertical retroreflective sensing arrangement. The horizontal sensing arrangement comprises a photosensor 128 and a retroreflective target surface 128A. The vertical sensing arrangement comprises a pair of photosensors 128B and 128C (hidden behind 128B) and a pair of retroreflective target surfaces 128D and 128E that are disposed upon the top surface of each of the opening fingers 125B. Target surfaces 128A, 128D, and 128E are of conventionally used retroreflective material, for instance retroreflective adhesive tape or pads as customarily used in conjunction with photosensors. Envelope 127 is shown in the same position as also depicted in FIG. 3A, being disposed in inserting station 32 in readiness for insertion. Opening fingers 125B are shown with their tips disposed in the opened pocket of envelope 127.

A horizontal sensing beam 129 is directed by photosensor 128 onto target surface 128A and is reflected back into the photosensor. Photosensor 128 detects any interruption of the beam 129. Beam 129 traverses at least the entire length of envelope 127 slightly above the upper surface of the opened envelope so that an obstruction of the beam in this region will be detected. For example, interruption of the beam 129 will occur as a consequence of malfunctions caused by damaged, misaligned, and buckled envelopes having been fed to inserting station 32, or by envelopes having been buckled or curled up by opening fingers 125B, for instance if suction cups 125A malfunction. Overall, any undesirable lifting up of a portion of the envelope 127 into the path of the beam 129 results in detection of a fault condition. Beam 129 also senses problems caused by and during insertion of insert stack packages. For instance, jamming by piling up of insert and envelope material will be detected. Sampling of the photosensor signal at appropriate times during the insertion cycle provides signals that are capable of discerning the type of malfunction more specifically.

Vertical sensing beams 129B and 129C are directed by photosensors 128B and 128C, respectively, toward target surface 128D and 128E, respectively, and are reflected thereby back into the respective photosensors, provided that the beams are not interrupted. In the depictions in FIGS. 3B and 3C, opening fingers 125B and therewith target surfaces 128D and 128E have entered into the opened target surfaces envelope 127. Consequently, sensing beams 129B and 129C are interrupted by the top side of the open envelope 127. Vertical sensing beams 129B and 129C primarily serve to detect the presence of a correctly opened envelope (having both fingers 125B inserted therein) by sampling of the signals generated by photosensors 128B and 128C at the appropriate time during the insertion operation. It has been found that the insertion jam detection arrangement, as described, is capable of detecting most, if not all, fault conditions that can potentially occur in the course of insertion. In case of detection of a fault condition, appropriate action is taken automatically under computer control, for example either by subsequent diversion of jammed material or by stoppage of the equipment and by fault location indication for the machine operator's attention.

Figure 4:
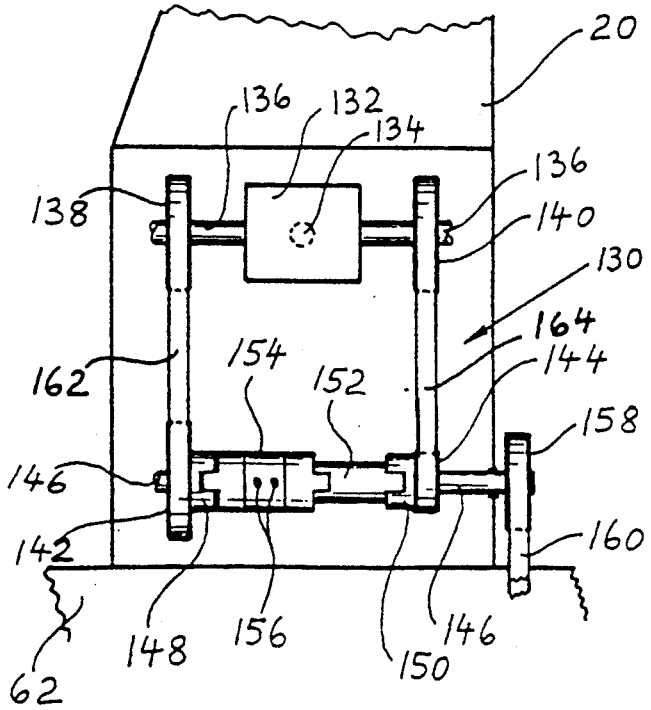
FIG. 4 is a schematic partial side elevation view of a speed change device of a modular rotary inserter station indicated in FIGS. 1 and 1A.

Referring to FIG. 4, a speed change device 130 is disposed within each insert feeder module, and serves to selectively change drive speed of the insert feeder operation, in general between normal speed and half speed (in a relationship to the speed of the pin conveyor 34). Speed change device 130 comprises an angle drive box 132 for driving the mechanism of insert feeder module (for instance 20) via a box axle 134, a box drive shaft 136 upon which a first and a second pulley 138 and 140 are mounted on either side of angle drive box 132, and a first and a second clutch pulley 142 and 144, both pulleys being borne in free-running manner upon a clutch drive shaft 146, and each pulley comprising a clutch half coaxially disposed therewith; namely a first clutch half 148 being comprised in first clutch pulley 142 and a second clutch half 150 being comprised in second clutch pulley 144.

Further comprised in speed change device 130 is a clutch shaft 152 disposed coaxially upon clutch drive shaft 146 between first and second clutch pulleys 144 and 146. Clutch shaft 152 is secured to clutch drive shaft 146 or it can be of unitary construction therewith. A double-sided claw clutch 154, including a clutch securing means 156, is borne coaxially slideably upon clutch shaft 152. Claw clutch 154 is selectably securable to clutch shaft 152 by clutch securing means 156 to either engage first clutch half 148 (as shown) or second clutch half 150 for driving of either first clutch pulley 142 or second clutch pulley 144, respectively. Clutch securing means 156 can be any conventional device used for such purposes (for instance screws) and claw clutch 154 can be slideably keyed upon clutch shaft 152 in conventional manner. Appropriate bearings (not specifically shown here) are provided for box drive shaft 136 and for clutch drive shaft 146. Clutch drive shaft 146 is provided with an inserter drive pulley 158 secured to one end thereof. An inserter drive belt 160 provides motive power to inserter drive pulley 158 from a here not shown motor-driven jack shaft that is located in main base 62 of the inserter apparatus.

First box pulley 138 is connected with first clutch pulley 142 by a first belt 162. Second box pulley 140 is connected with second clutch pulley 144 by a second belt 164. In the embodiment shown in FIG. 4, second clutch pulley 144 is one half the diameter of the first clutch pulley 142, while pulleys 138 and 140 are of the same diameter. The shown clutch engagement results in a first drive speed transmitted to angle drive box 132. The alternate selectable clutch engagement results in a drive speed transmitted to angle drive box 132 that is one half of the first drive speed. Other preselectable drive change ratios can be chosen by appropriate relationships between pulley diameters.

The half speed facility is generally preselected when inserts may be difficult to handle at high speeds, as for instance given by inserts from very thin materials. In such cases, for example, two feeder modules are used to provide the same more difficult to handle inserts, each module operating at one half of the speed of other insert feeder modules. This provides the capability of high delivery rate without a need for slow-down of the entire apparatus.

Figure 5:
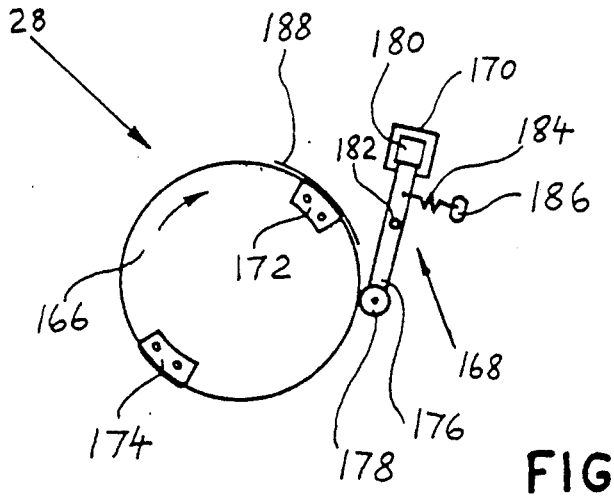
FIG. 5 is a schematic partial detail side view of an embodiment of an insert thickness sensing arrangement of the invention.

Referring now to FIG. 5, insert thickness detector 28, disposed in every feeder module (for instance 20), comprises an insert gripper drum disc 166 of an insert gripper drum employed for delivery of inserts from a hopper to pin conveyor 34. Thickness detector 28 further comprises a detector caliper assembly 168 and a Hall sensor device 170. First and second anvils 172, 174 are adjustably secured to a face of drum disc 166 and are spaced apart by 180 degrees. Peripheral surfaces of anvils 172, 174 are flush with or slightly raised above the periphery of insert gripper drum disc 166. Detector caliper assembly 168 comprises a caliper arm 176, a follower roller 178 mounted at one end of arm 176, a permanent magnet 180 mounted at the other end of arm 176, a caliper pivot 182 upon which arm 176 is rotatably borne, and a tension anchor spring 184 spring-loading arm 176 so that roller 178 rides upon the periphery of disc 166 and over anvils 174. Spring 184 is anchored to an anchor 186 that is secured to the module's frame. Caliper pivot 182 and Hall sensor device 170 are also secured to the inserter module frame. Hall sensor 170 senses lateral displacement of the magnet 180 and generates a corresponding electrical signal which is a measure of the thickness of an insert passed between disc 166 (or anvils 172, 174) and roller 178. For example, an insert 188 is indicated in a proper position while being conveyed by and upon the gripper drum (disc 166).

In operation, the insert gripper drum revolves about its axis carrying inserts gripped upon its periphery and transporting such inserts in generally conventional manner. Anvils 172, 174 are adjusted to have their peripheral surfaces concentric about the axis of rotation of gripper drum disc 166, as the periphery of the latter may not be sufficiently concentric to serve as a reference. The signal generated by the Hall sensor 170 corresponds to the radius followed by follower roller 178 about the axis of rotation of disc 166. Consequently, the signal from the Hall sensor provides a measure of insert thickness calipered between roller 178 and an anvil.

Anvils 172 and 174 are not required in another embodiment, wherein the Hall sensor provides reference signals corresponding to disc periphery radii in insert-carrying locations in absence of inserts thereupon. These reference signals are computer-stored and compared wit the insert thickness signals obtained when an insert is present. Consequently, lack of concentricity of the periphery of disc 166 is compensated.

Insert thickness detector 28 is used in insert feeder modules particularly as a so-called "miss and double detector" to detect faulty equipment operation such as given by an absence of an insert or the presence of more than one insert thickness. In general, Hall sensor signals are compared with preset limits, corresponding to thickness ranges, to allow for permissible thickness variations and tolerable dimensional structural changes.

Figure 5A:
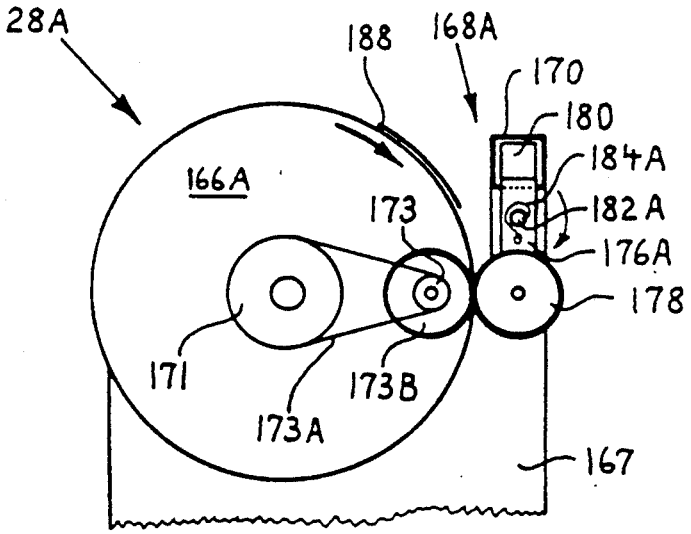
FIG. 5A is a schematic partial detail side view of another embodiment of an insert thickness sensing arrangement of the invention.

Yet another embodiment of an insert thickness detector, designated by the numeral 28A, is shown in FIG. 5A. An insert gripper drum 166A and a caliper assembly 168A are borne and mounted on a common frame structure 167. Caliper assembly 168A comprises a fixed Hall sensor device 170 and caliper arm 176A. The latter is pivotably borne upon a caliper pivot 182A which is mounted in a fixed position with respect to frame structure 167. Caliper arm 176A has a follower roller 178 freely rotatably mounted at one end thereof. The other end of caliper arm 176A is provided with a permanent magnet 180 whose magnetic field is sensed by Hall sensor device 170.

A pulley 171, mounted on the axle of the insert gripper drum 166A, is commonly driven at the same angular velocity as the insert gripper drum. A further pulley 173 is freely rotatably borne upon a shaft that is mounted in a fixed position with respect to common frame structure 167. Pulley 173 is driven from pulley 171 via a belt 173A. A precision caliper roll 173B is coaxially mounted with pulley 173 and driven thereby. A point on the periphery of caliper roll 173B is always disposed so as to substantially coincide with a cylindrical surface within which falls the periphery of the insert gripper drum 166A. Caliper roll 173B and follower roller 178 are both disposed in substantially the same vertical plane which is located on one side and in the vicinity of one face of insert gripper drum 166A. The nip formed between roll 173B and roller 178 intercepts overhanging portions of inserts being transported upon drum 166A. In absence of inserts being calipered, follower roller 178 contacts caliper roll 173B and is driven thereby. This contact is enforced by spring loading of caliper arm 176A by torsion spring 184A.

The transmission ratio between drum 166A, pulleys 171 and 173, and caliper roll 173B is such that the peripheral velocities of insert gripper drum 166A and caliper roll 173B are identical. Belt 173A is resiliently elastic, particularly along its length, in order to accomodate velocity fluctuations between the two pulleys.

In operation, when an insert, for instance indicated insert 188, is transported upon insert gripper drum 166A, the insert is also nipped between caliper roll 173B and follower roller 178, and is driven thereby substantially at the speed of the gripper drum periphery. Follower roller 178 is displaced by the insert thickness, and magnet 180 is correspondingly displaced from its reference position along Hall sensor device 170. The difference between the Hall sensor signals in absence and in presence of a nipped insert provides an accurate measure of insert thickness. As inserts extend beyond both sides of the insert gripper drum into the nip region between caliper roll 173B and follower roller 178, lack of concentricity, vibration, and other gripper drum periphery deviations do not affect the measurement, because caliper roll 173B is rigidly borne in the frame structure of the apparatus and is not subject to errors due to such cases. The elasticity of belt 173A facilitates also calipering of relatively thick inserts, as the belt will stretch to adapt to corresponding fluctuations in velocity of caliper roll 173B.

Figure 6:
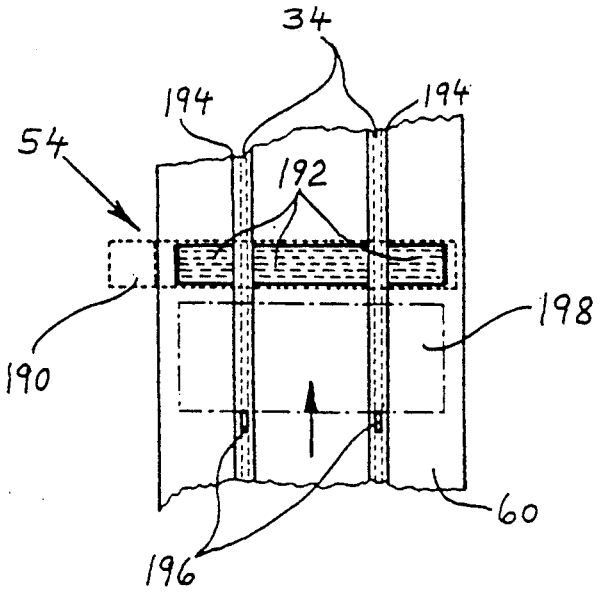
FIG. 6 is a schematic fragmented top view onto a portion of an insert conveying surface of an in-line rotary inserter of the invention.

Referring now particularly to FIG. 6 in conjunction with FIGS. 1, 1A and 2, 2A, skew detector arrangement 54 is disposed on and above main track bed 60 and comprises a skew detector bridge 190 having a plurality of downwardly-looking photosensors mounted therein. A plurality of retroreflectors 192 is disposed below skew detector bridge 190 upon the upper surface of main track bed 60. Skew detector bridge 190 is indicated in dotted lines in FIG. 6. Pin conveyor 34 (indicated by dash lines) is disposed beneath the surface of main track bed 60 and comprises, in two parallel rows, a plurality of equi-spaced upwardly-pointing pusher pins 196 (two of which are shown here) which protrude above the main track bed through slots 194 and which move therein along the track bed. A typical insert stack package 198 (indicated by phantom lines) is shown as it is pushed along the surface of track bed 60 by pusher pins 196, being conveyed thereby from inserter modules to envelope inserting station 32.

Photosensors in skew detector bridge 190 are directed toward retroreflectors 192 so that the presence of an insert stack is sensed. In particular, the sensing operation is timed in synchronism with the conveying motion of pin conveyor 34. Leading and trailing edges of insert stack package 198 are sensed in a plurality of transverse locations across main track bed 60 over retroflectors 192. Detected signal levels of individual photosensors are compared for transversal incidence timing by sensing of relative obstruction of retroreflector areas by insert stack package edges. These signal are evaluated in dependence on machine speed, thusly establishing limiting tolerance levels for permissible skew and other misalignments as a function of machine speed. Limiting tolerance levels are preprogrammable in order to provide allowance for different insert materials and, particularly, to establish automatic rejection thresholds for insert stack package skew and misalignment.

Figure 7:
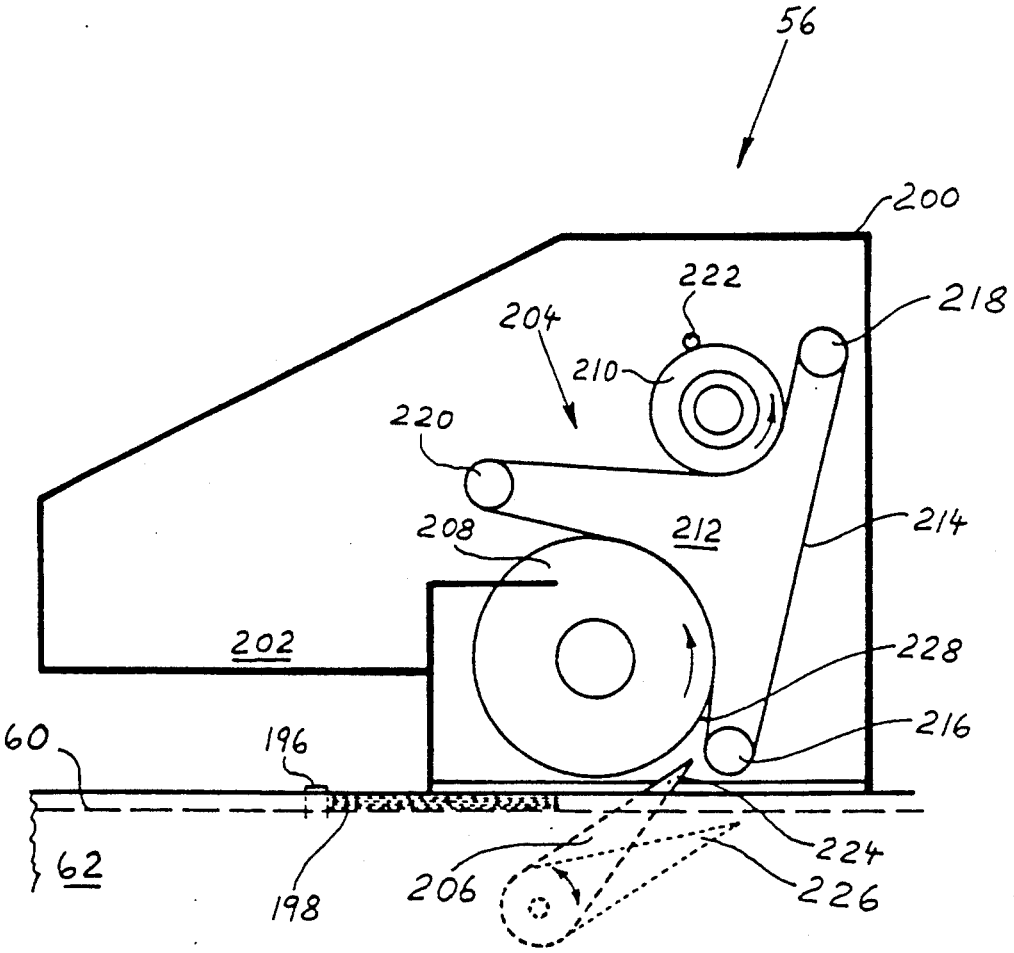
FIG. 7 is a schematic fragmented side elevational view of a diverter of the present invention.

Referring now to FIG. 7, an insert diverter 56 is depicted in side elevation as it is disposed upon main base 62. Also indicated here is a pusher pin 196 of pin conveyor 34 as it pushes insert stack package 198 along upper surface of main track bed 60 (from left to right). Insert diverter 56 comprises a diverter housing 200, an insert reject catch tray 202, and a divert pulley system 204. Although disposed within main base 62, a selectively positionable two-position reject gate 206 including its actuating mechanism is a part of insert diverter 56. Divert pulley system 204 comprises a motor-driven divert drive roller/pulley 208, a motor-driven belt drive pulley 210, and a triple pulley belt arrangement 212 including an endless divert belt 214. Belt arrangement 212 comprises a floating idler pulley 216 which is carried by a here not shown lever that freely pivots about the axis of belt drive pulley 210 and that is spring loaded in a clockwise direction against an adjustable stop. This lever also carries an idler lever pivot 222 which is linked by a here not shown link to the axle of a take-up pulley 218. This link is spring loaded about the axis of pivot 222 in counter-clockwise direction to keep divert belt 214 tensioned. A fixed idler pulley 220 is borne in fixed position within housing 200. Resiliently tensioned divert belt 214 is driven by belt drive pulley 210. It should be understood that a plurality of substantially identical components is disposed in spaced parallel arrangement perpendicularly to the plane of the depiction, as is customary in sheet material handling mechanisms.

In operation, when an insert stack package is to be diverted, reject gate 206 is raised to its upward reject position 224 from its by-pass position below the surface of main track bed 60. The insert stack package (such as package 198, for example) is consequently pushed onto reject gate 206 by the normal conveying motion from pusher pins 196. The insert package is thusly guided into a reject nip region 228 between divert belt 214 and divert drive roller/pulley 208. The package is grabbed in nip region 228 and lifted upwardly away from the path of pusher pins 196, is carried about roller/pulley 208, and is thereby transferred into reject catch tray 202. Reject gate 206 is thereafter returned to its by-pass position 226. Positioning of reject gate 206 is performed in conventional manner, for example by a spring-loaded solenoid in response to appropriate energizing signals that are, for example, supplied from main computer 50 (or from a subsystem thereof). Insert stack packages stigmatized as faulty (for example misaligned or skewed) are thusly diverted. Also diverted here can be insert packages containing misfed inserts (misses or doubles) and insert packages whose associated envelope is missing or misfed (double), damaged, or otherwise faulty. If the number of misfeeds exceeds a preprogrammed number, the equipment is stopped.

Another preferred embodiment of the in-line rotary inserter apparatus is shown diagrammatically in FIG. 1A. The left hand portion of FIG. 1A is identical to the left portion of FIG. 1 (including also envelope feed station 30 and a vacuum belt transporter/diverter unit), but differs from FIG. 1 in that unit 36, now designated 36A, is somewhat modified. Unit 36A now feeds (toward the right) a turnover module 40A via a diverter section 47A. Turnover module 40A, in turn feeds a sealing module 38A which is further connected to and feed a postage meter module 49A via a lift gate section 48A. On-edge stacking/diverter unit 42, fed from postage meter module 49A, is substantially the same as unit 42 shown in FIG. 1 (and FIGS. 11–15) and can be further connected to additional handling equipment 46.

Diverter section 47A can be substantially similar to the diverter device illustrated in FIG. 7 and as described in conjunction therewith, although various other diverters can be employed instead. Diverter section 47A serves to divert unsealed envelopes either for normal operation processing reasons or when fault conditions occur.

Referring now to the embodiment shown in FIG. 2A (for instance also in conjunction with FIG. 1A), it will be seen that the depiction is in many respects substantially identical to FIG. 2, except that the vacuum belt transporter/diverter unit, now designated with the numeral 36A, comprises a transverse pass 64A having a substantially horizontal surface 70A with a short fall region 74A thereabove. Further in this embodiment, the envelope conveyor device, now designated with the numeral 82A, includes an upper belt device 83A following a somewhat different belt path (than device 83 of FIG. 2), and the envelope diverter, now designated with the numeral 33A, includes a deflector and belt device 86A (and excludes stop gate 86 of FIG. 2). The embodiment of FIG. 2A will be described hereinafter only in regard to those aspects differing significantly from the aspects of FIG. 2. In other respects, reference should be made to foregoing detail descriptions given in conjunction with FIG. 2.

Vacuum belt transporter/diverter unit 36 of FIG. 2 can feed other modules or subsystems as depicted, for instance, in FIG. 1A and, similarly, vacuum belt transporter/diverter 36A of FIG. 2A can feed other modules or subsystems as depicted, for instance, in FIG. 1, provided suitable transition means are interposed to adapt the respectively sloping and horizontal envelope orientations along the envelope transfer delivery path.

Referring to FIG. 1A, envelope conveyor device 82A comprises a pair of driven endless belts disposed one above the other. Upper belt devices 83A includes a generally straight lower portion in nipping contact with the upper portion of the lower belt. An upper portion of the upper belt device 83A is partially carried and driven by a pulley having substantially the same diameter as second gripper drum 78 and forming a part thereof, as indicated in FIG. 2A. Envelopes are delivered by and upon second gripper drum 78 to the nip between upper belt device 83A and the upper portion of the lower belt, and are transported thereby toward the left into proximity of vacuum gripper drum 84 in readiness for pick-up by appropriate grippers of drum 84.

An envelope diverter 33A comprises a deflector and belt device 86A and an envelope reject bin 85C. Deflector and belt device 86A is disposed in the region between envelope conveyor device 82A and vacuum gripper drum 84, and comprises a deflector 85 and an endless belt 85B driven about a pair of pulleys. The axle of the upper pulley serves also as pivot 85A about which deflector 85 is selectively pivotable between two positions. One position, as indicated, offers an upper deflector surface to envelopes delivered thereto, so that an envelope resting upon this upper deflector surface can be picked up by the next grippers of vacuum gripper drum 84. Deflector 85 is pivoted into the other position anticlockwise by a small angle so that the right-hand scoop-like face of deflector 85 scoops and diverts therealong a delivered envelope downwardly. The leading edge of a thusly downwardly deflected envelope will contact the right-hand side of belt 85B, and will be driven thereby farther downwardly until it falls into bin 85C. The envelope diverter 33A serves to selectively divert envelopes (for instance, reject or faulty envelopes) before they can reach inserting station 32.

Figure 8:
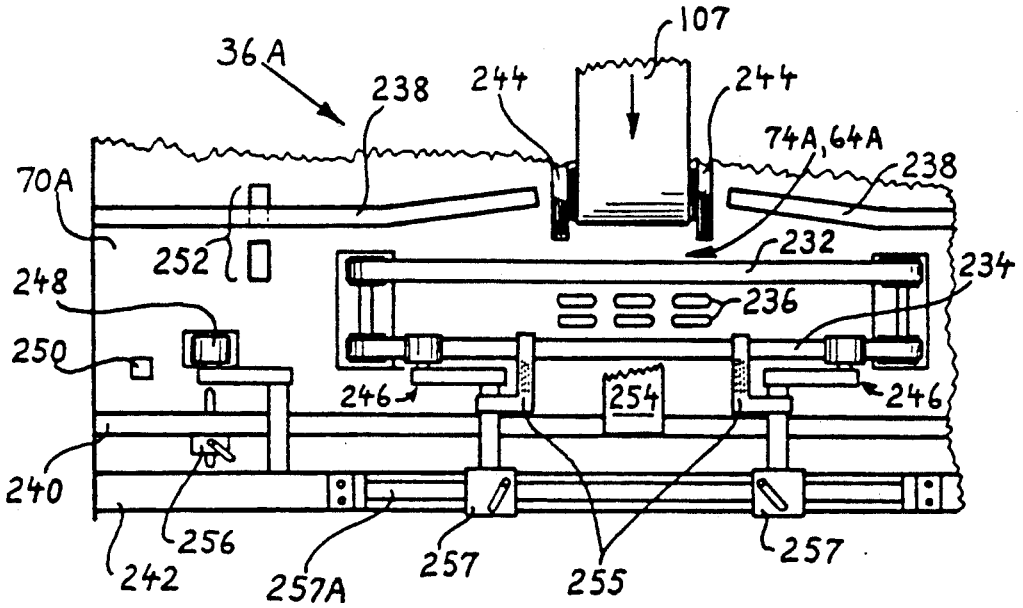
FIG. 8 is a schematic top view of a vacuum belt transporter/diverter unit of the present invention.
Figure 8A:
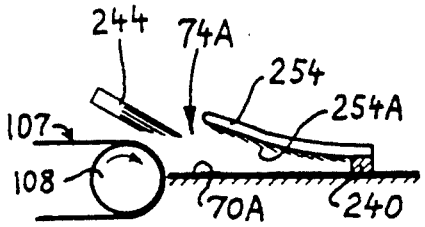
FIG. 8A is a schematic fragmental vertical section view of a portion of the unit of FIG. 8.
Figure 8B:
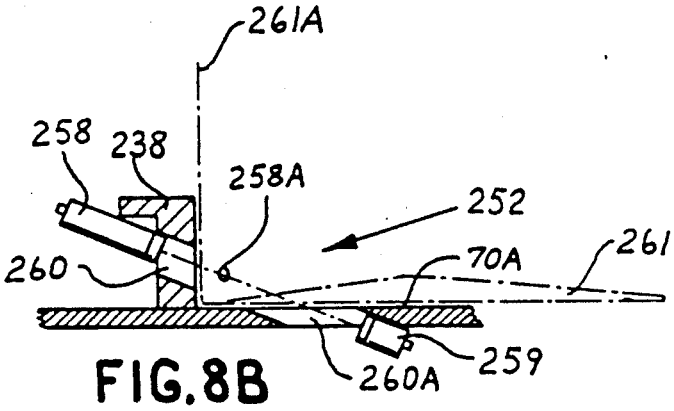
FIG. 8B is a schematic side view of an envelope scanner as indicated in FIG. 8.

FIGS. 8, 8A, and 8B depict detail aspects of vacuum belt transporter/diverter unit 36A and show a delivery end portion of conveyor belt arrangement 107 for conveying from inserting station 32 envelopes filled with inserts. FIG. 8A shows additional details in the short fall region 74A of the transverse pass 64A in a partial side view similar to the view of this region given in FIG. 2A. Conveyor belt arrangement 107 conveys envelopes into fall region 74A of transverse pass 64A and deposits envelopes onto surface 70A of vacuum belt transporter/diverter unit 36A.

Vacuum belt transporter/diverter unit 36A comprises surface 70A of a support structure for the unit, first and second parallel vacuum belts 232 and 234 having a plurality of vacuum openings 236 disposed in a region therebetween in surface 70A (or in a block mounted in surface 70A), at least one guide rail 238 and one adjustable rail 240, and a mounting bar 242 fixed on surface 70A. Vacuum belt transporter/diverter unit 36A further comprises a pair of fall brushes 244 disposed in the vicinity of and above the delivery end of conveyor belt arrangement 107, at least one adjustable spring-loaded pressure roll unit 246, and at least one drive pressure roll 248 spring loaded against a driven roll that is disposed beneath surface 70A. Further included in vacuum belt transporter/diverter 36A is a monitoring photosensor 250 and a raised envelope scanner 252, a deflector 254 including bristles 254A disposed upon the deflector's lower surface, and brush arrangements 255 included in adjustable pressure roll unit 246.

It should be recognized that vacuum belt transporter/diverter unit 36A is substantially symmetrical about a vertical plane disposed through the middle of conveyor belt arrangement 107, although the depiction in FIG. 8 shows one side partly fragmented.

First and second vacuum belts 232 and 234 are driven endless belts having their upper surface disposed substantially slightly above surface 70A, so that an envelope can be transported upon these belts. In particular, an envelope delivered by conveyor belt arrangement 107 onto these belts in the region above vacuum openings 236 clings securely to the belts by the action of vacuum fed via vacuum openings 236 (from a vacuum source here not shown). A thusly delivered envelope is deflected downwardly by fall brushes 244 and by deflector 254, and is stopped by rail 240. Bristles 254A are oriented in direction of the envelope delivery movement and serve to reduce envelope bounce upon delivery. Rail 240 provides for registration of an envelope edge, and is repositionable by adjustable fastening means 256 to accommodate different size envelopes.

Guide rails 238, curved along their leading ends, serve to guide opposed envelope edges into definite positional registration therealong and along rail 24. Pressure roll units 246 each comprise an idler roller mounted in a spring-loaded crank device whose position is relocatable by a block 257 along an adjustment rail 257A. Units 246 also include brushes 255 mounted thereon with bristles directed downwardly and angled to facilitate delivery of envelopes thereunder. Brushes 255 serve to push envelopes onto belts 232 and 234, particularly as envelopes are transported by the belts toward one or the other side and away from the region of vacuum openings 236. Idler rollers of pressure roll units 246 are positioned above and spring loaded onto belt 234. Pressure roll units are adjustably relocatable to accommodate different envelope sizes, so that envelopes transported by belts 232 and 234 are engaged by the nip between the idler roll and belt 234 before they leave the influence of vacuum in the region of vacuum openings 236, and so that envelopes remain engaged in this nip at least until they are transported in the nip between drive pressure roll 248 and a driven roll therebeneath. Drive pressure roll 248 is an idler roll mounted upon a crank arm, and is spring loaded against the driven roll therebeneath.

A monitoring photosensor 250 is shown in surface 70A on the left side of drive pressure roll 248 for purposes of sensing and monitoring envelopes being delivered to farther equipment. Sensor 250 facilitates supervisory and control functions of multiple subunit arrangements, for instance, via computer 50.

FIG. 8B shows details of a raised envelope scanner 252 (also indicated in FIG. 8). Raised envelope scanner 252 comprises a beam emitter 258 generating a light beam 258A and includes a beam pick-up 259 arranged in line therewith. Emitter 258 emits beam 258A angled across a corner formed between surface 70A and guide rails 238 through slots 260 (in rail 238) and 260A (in surface 70A). Beam 258 is intercepted by an envelope transported therethrough in vacuum belt transporter/diverter unit 36A, provided the envelope is correctly registered between rails 238 and 240 and provided that its inserts are properly fully inserted. This is indicated by envelope 261 (in dashed lines) having flap 261A raised. If inserts are, for instance, incompletely inserted and protrude past the flap hinge edge, the envelope flap is stiffened in a more horizontal orientation. Consequently, such an envelope is not disposed upon surface 70A in the vicinity of guide rail 238 subsequently to its delivery to and during transport by vacuum belt transporter/diverter unit 36A, and it will not be scanned while passing by raised envelope scanner 252. Such an envelope may ride with its stiffened flap upon rail 238. Other faulty envelopes, such as for example having damaged, bulged, improperly folded or other insert faults can also result in absence of a interception by scanner 252. Thus scanner 252 serves to detect such malfunctions.

In operation of vacuum belt transporter/diverter unit 36A, an insert-filled envelope is delivered with flap-edge trailing by conveyor belt arrangement 107 onto vacuum belts 232 and 234. Vacuum is fed to the bottom of the envelope via vacuum openings 236 to pull the envelope onto the belts, and the envelope is transported on and by the belts either to the right or to the left, depending on the direction of belt motion. The envelope is further transported to the side of the unit and to farther equipment through a nip between drive pressure roll 248 and a driven roller therebeneath. A reversing gearing and clutch arrangement can be provided to reverse the drive to vacuum belts 232 and 234 and to thusly facilitate selective quick change over and diversion of envelopes to the right or the left. For example, as indicated in FIG. 1A, vacuum belt transporter/diverter unit 36A can deliver insert-filled envelopes via a reject diverter section 47A to a turnover module 40A and farther to a sealing module 38A.

Figure 9:
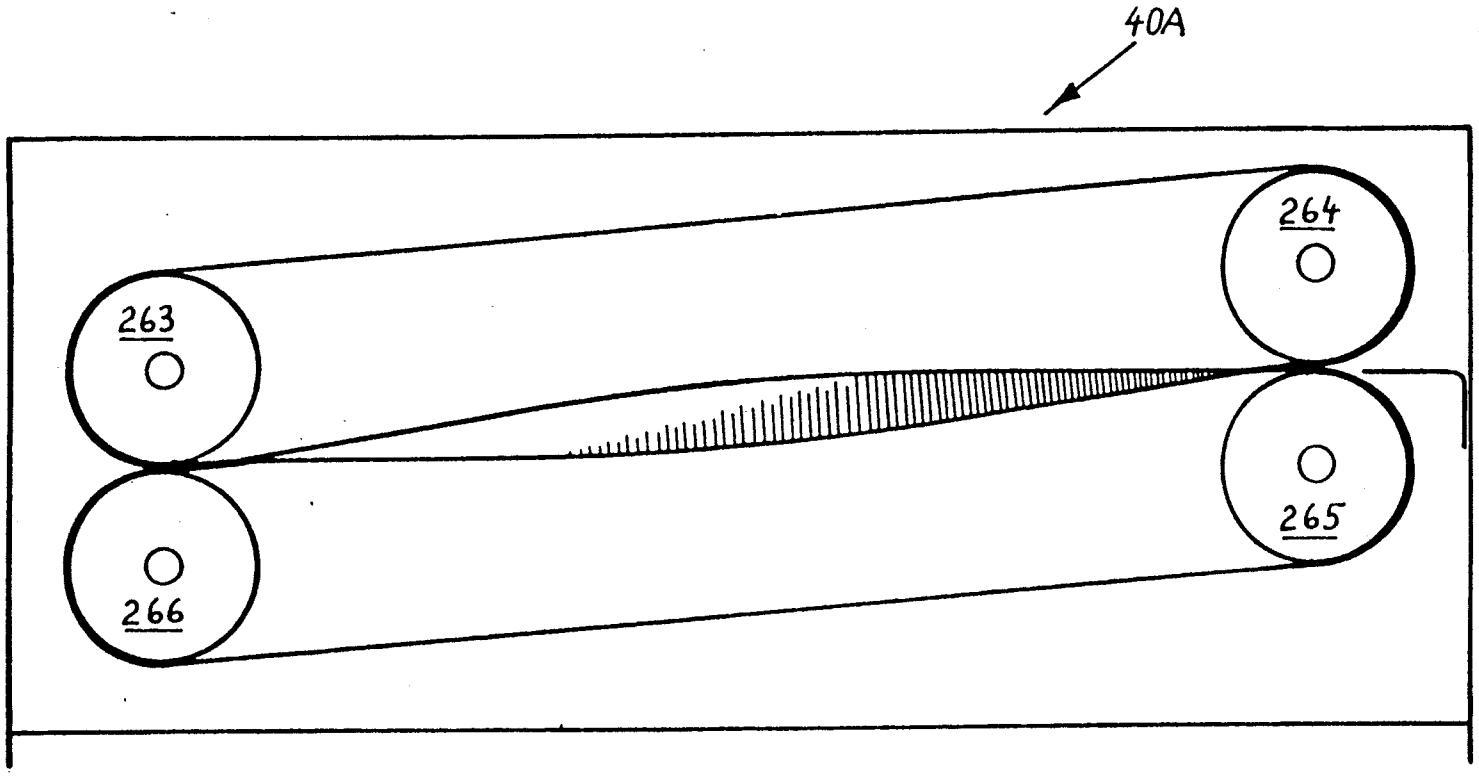
FIG. 9 is a schematic side elevational view of basic features of an envelope turnover module of the invention.
Figure 9A:
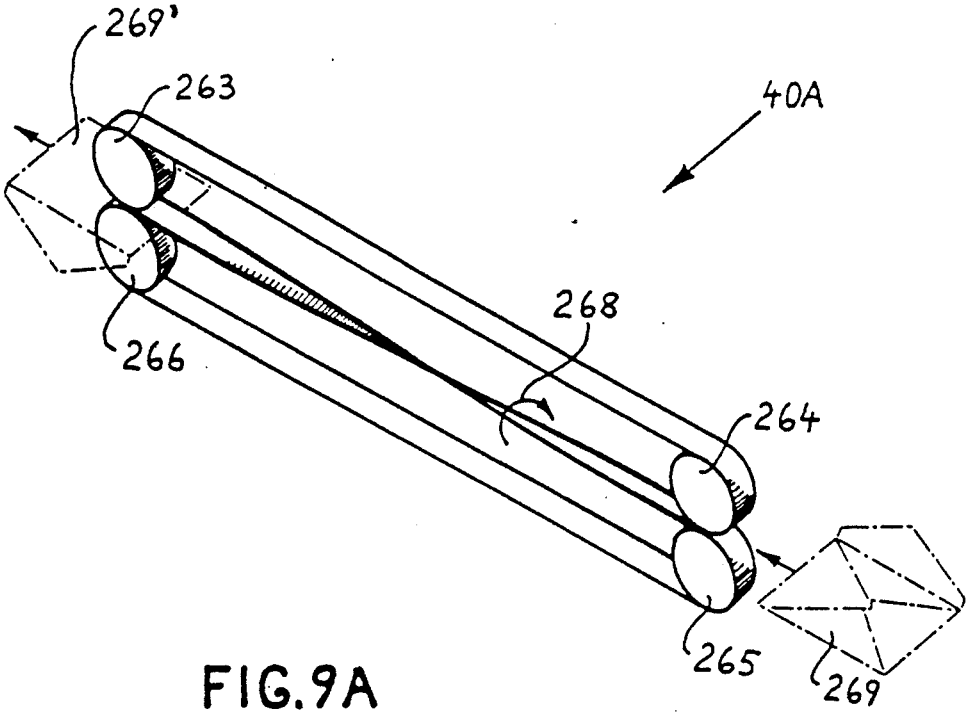
FIG. 9A is an isometric view of basic features of the turnover module shown in FIG. 9.

Referring now to FIGS. 9 and 9A, key aspects of turnover module 40A depicted therein comprise a module frame and housing 262, idler pulleys 263, 264, and 265, and a driven pulley 266. All four pulleys are disposed substantially in the same vertical plane and are rotatably borne. Pulleys 265 and 266 have their centers disposed in fixed positions with respect to housing 262. Pulleys 263 and 264 revolve about horizontal axles which are spring-loaded downwardly. These axles can move by a small distance substantially vertically between stops in the spring-loaded range. One stop is set to provide a fixed smallest gap between upper and lower pulleys. The other stop is adjustable to provide a maximum gap between upper and lower pulleys. For instance, axles of pulleys 263 and 264 are first axles of approximately horizontally oriented spring-loaded cranks whose second axles are rotatably borne in module frame and housing 262. The angle of spring-loaded crank rotation is limited by and between the two stops.

An endless flat belt 267 is carried in figure-eight form by the four pulleys in such a way that the mutually contacting cross-over belt portions form a one hundred and eighty degrees twist about one another in the stretch between the left pulleys (263, 266) and the right pulleys (264, 265). In order to permit this belt layout, endless flat belt 267 is produced by twisting a straight flat belt by seven hundred and twenty degrees and by joining the ends to one another. As carried upon the four pulleys, mutually contacting cross-over belt portions twist in clockwise direction about one another to provide clockwise turnover of envelopes, as indicated in FIG. 9A by arrow 268, when envelopes are transported from right to left through turnover module 40A. A typical entering envelope 269 is shown in phantom lines being delivered to the nip of the cross-over belt portions. A typical egressing envelope 269' is shown in phantom lines being delivered from the nip of the cross-over belt portions, having been turned from a flap-up to a flap-down orientation.

The fixed smallest gap between upper and lower pulleys is set to facilitate nipping and transport passage between the belt portions of a thinnest envelope to be handled. The other stop is adjusted to a gap between upper and lower pulleys to facilitate nipping and transport passage between the belt portions of the thickest envelope to be handled.

Figure 10:
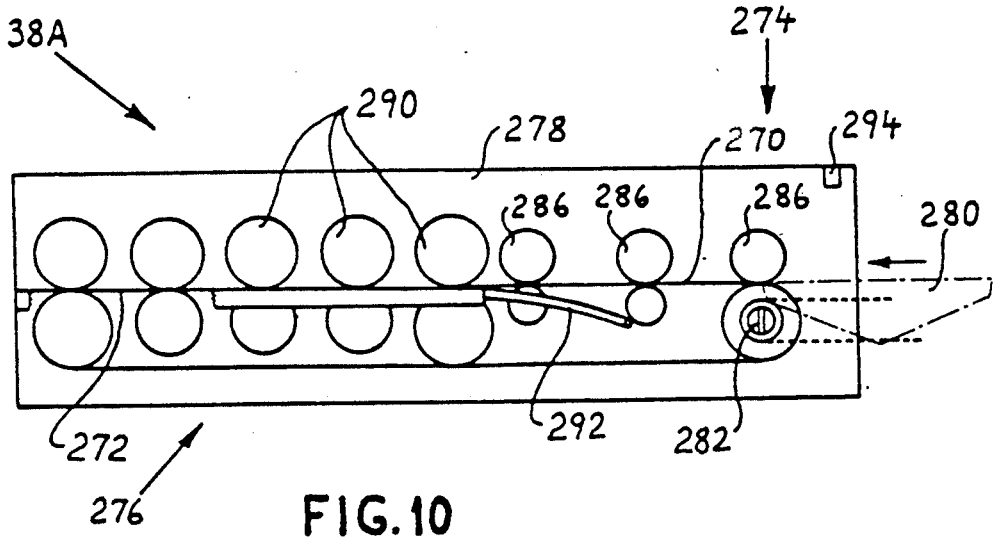
FIG. 10 is a schematic partial side elevational view of an envelope sealing module of the invention.
Figure 10A:
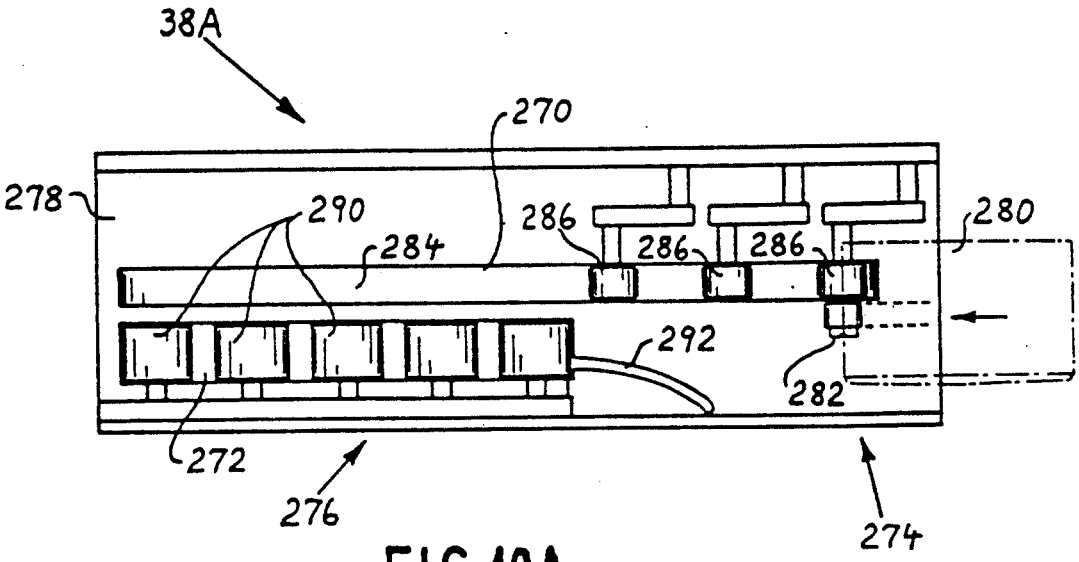
FIG. 10A is a schematic partial top view of the embodiment shown in FIG. 10.

Referring now to FIGS. 10 and 10A, features of sealing module 38A shown therein comprise a first belt conveyor 270 and a second belt conveyor 272 upon which envelopes are conveyed, a flap moistening section 274, a flap sealing section 276, and a frame structure 278 on which the various components are mounted. A typical envelope 280 is shown (in phantom lines) as it is delivered from turnover module 40A to flap moistening section 274. Envelope 280 is oriented substantially in a horizontal plane having its still open flap oriented substantially vertically and pointing downwardly.

Flap moistening section 274 comprises a spray nozzle 282 for issuing of a water spray onto the inner surface of flaps of envelopes that intercept the spray while being conveyed through flap moistening section 274. The spray is particularly directed at the gummed portion of envelope flaps, and is provided preferably in form of a fan pattern that has a well-defined fan angle and pattern thickness extent in order to reduce moistening of other than flap surfaces of an envelope. The fan pattern is preferably oriented in a generally lateral and vertical plane, but can be alternately oriented in other generally lateral planes. For example, suitable spray nozzles can be of a conventional shear type having a slit exit and providing high liquid shear forces to break up flow into droplet spray. Alternately, suitable nozzles can be of a fluidic oscillator type which break up flow into relatively well-defined droplet spray patterns.

First belt conveyor 270 comprises a driven endless belt arrangement having an upper belt surface 284 oriented substantially horizontally for conveying of envelopes through sealing module 38A. Disposed at least in the region of flap moistening section 274, a plurality of pressure rolls 286 is spring loaded onto upper belt surface 284 to form a nip for nipping and thereby more securely conveying envelopes through sealing module 38A. Second belt conveyor 272, commonly driven with first belt conveyor at the same speed, is provided with pressure rolls 290 for exerting of pressure onto a moistened and folded closed flap of an envelope whilst the envelope is conveyed under rolls 290 on top of belt conveyor 272.

A closing guide 292 is disposed in a region that leads into flap sealing section 276. Guide 292 serves to intercept moistened envelope flaps and to bend the flaps upwardly into substantially closed orientation, so that the flap can be sealed subsequently by compression action between second belt 272 and pressure rolls 286, as an envelope is conveyed through flap sealing section 276. As indicated in FIGS. 10 and 10A, guide 292 has a compound shape, being curved both downwardly and laterally in direction toward an incoming envelope, and is disposed entirely beneath the horizontal envelope conveying plane (given by the upper surface of second conveyor belt 272). Guide 292 intercepts and slides along the outer surface of an envelope flap fed thereto, while gradually pushing the flap into its closed position.

In operation of sealing module 38A, envelopes are fed thereto seriatim in the orientation and position shown by typical envelope 280. As an envelope is conveyed by first belt 270 (toward the left) past spray nozzle 282, its flap is moistened over its gummed region by spray from this nozzle and, while the envelope is conveyed farther to the left into the nip between second belt 272 and pressure rolls 290, the flap is closed by closing guide 292. Thereafter, rolls 290 in combination with belt 272 seal the flap while the envelope is conveyed to the left hand side of the sealing module and delivered therefrom to farther equipment. A photosensor 294 can be provided to detect ingress of an envelope in order to actuate a solenoid valve to feed water to nozzle 282 during passage of the envelope, so that water is sprayed only when a flap requires moistening. Alternately, spraying can be continuous while a continuous stream of seratim envelopes is conveyed.

It should be recognized that the generally vertical orientation of the downwardly pointed envelope flap during the spray moistening operation is particularly advantageous. For all practical purposes, this orientation avoids wetting of the envelope body and of inserts contained therein. Moreover, spray droplets that miss a flap or that bounce off or flow down on the flap cannot wet the envelope. The latter droplets are collected in a here not specifically shown tray with appropriate wall shields and are drained away. It should be further recognized that nozzle 282 (and its operating pressure) is preferably chosen to provide a spray with droplet sizes above those which could form a significant proportion of floating mist in order to minimize moistening of machine parts. Consequently, preferably droplet sizes are chosen to be above approximately 100 microns, and are preferably substantially in a range above about 200 microns and larger.

Sealed envelopes are delivered by sealing module 38A, for instance, to a lift gate section 48A that is indicated in FIG. 1A. Lift gate section 48A is provided for passing sealed envelopes delivered thereto onward to postage meter module 49A (FIG. 1A). Lift gate section 48A includes a transport conveyor mechanism of conventional kind and is arranged to facilitate lifting and tilting of its structure out of the way to permit, for instance, a machine operator to pass from one to the other side of the equipment when operation is interrupted. Envelopes delivered by lift gate 48A are processed in postage meter module 49A and are delivered therefrom to on-edge stacking/diverter unit 42. Postage meter module 49A is a conventional apparatus as customarily employed in mass-processing of mailable articles, and will not be further described herein.

Figure 11:
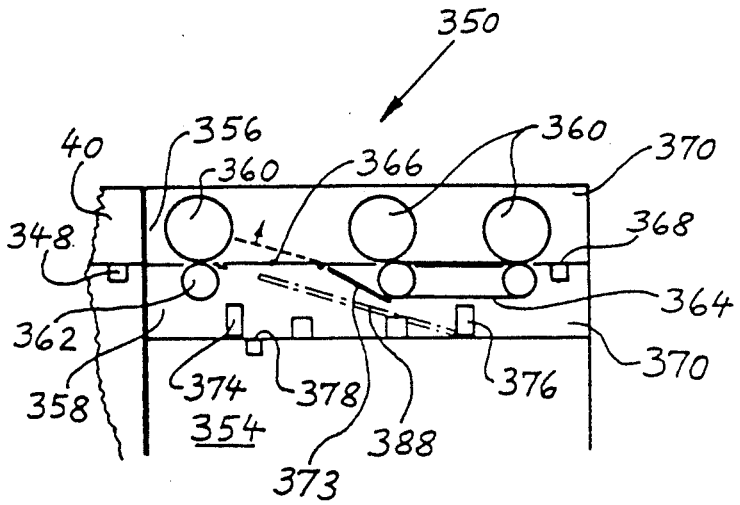
FIG. 11 is a schematic partial fragmented front view and section of a diverter portion of an on-edge stacking unit of the invention.
Figure 12:
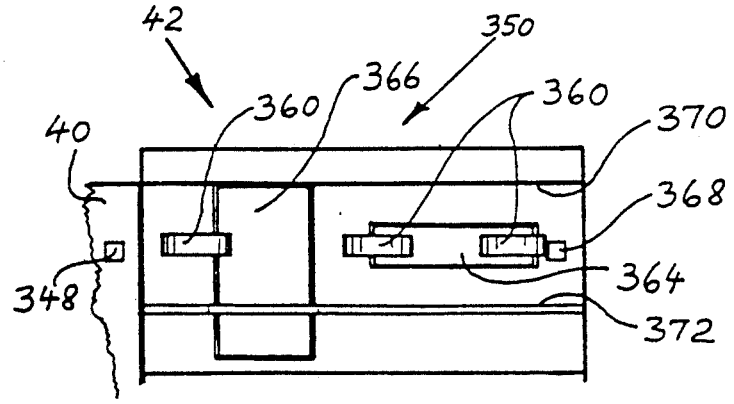
FIG. 12 is a schematic partial fragmented top view of the unit shown in FIG. 11.
Figure 13:
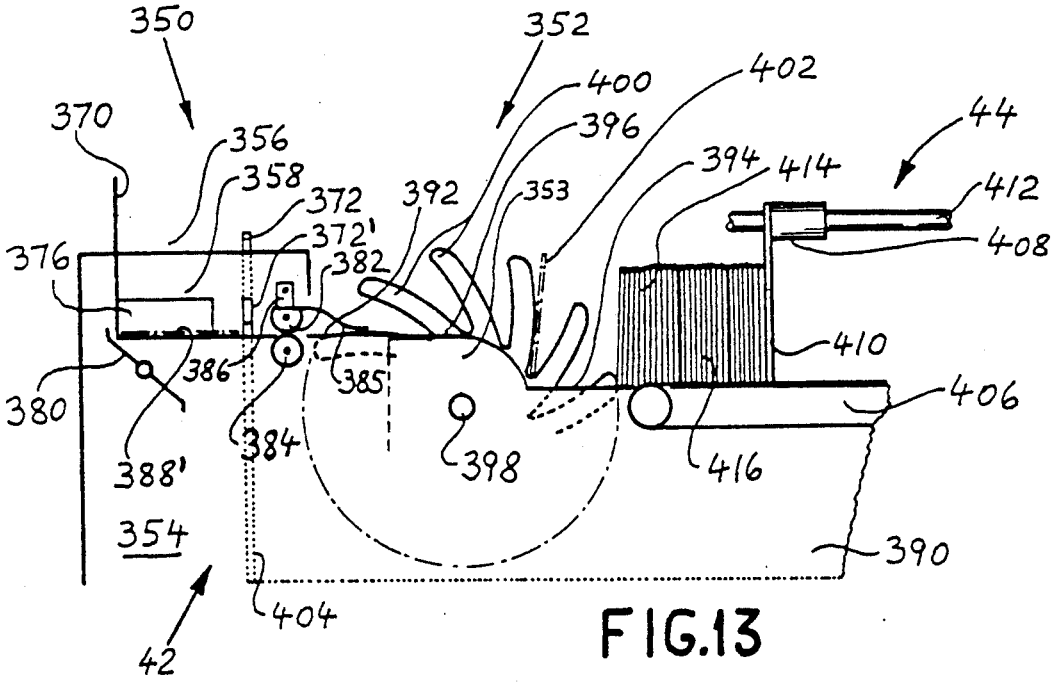
FIG. 13 is a schematic partial fragmented side view and section of an on-edge stacking unit of the invention.
Figure 14:
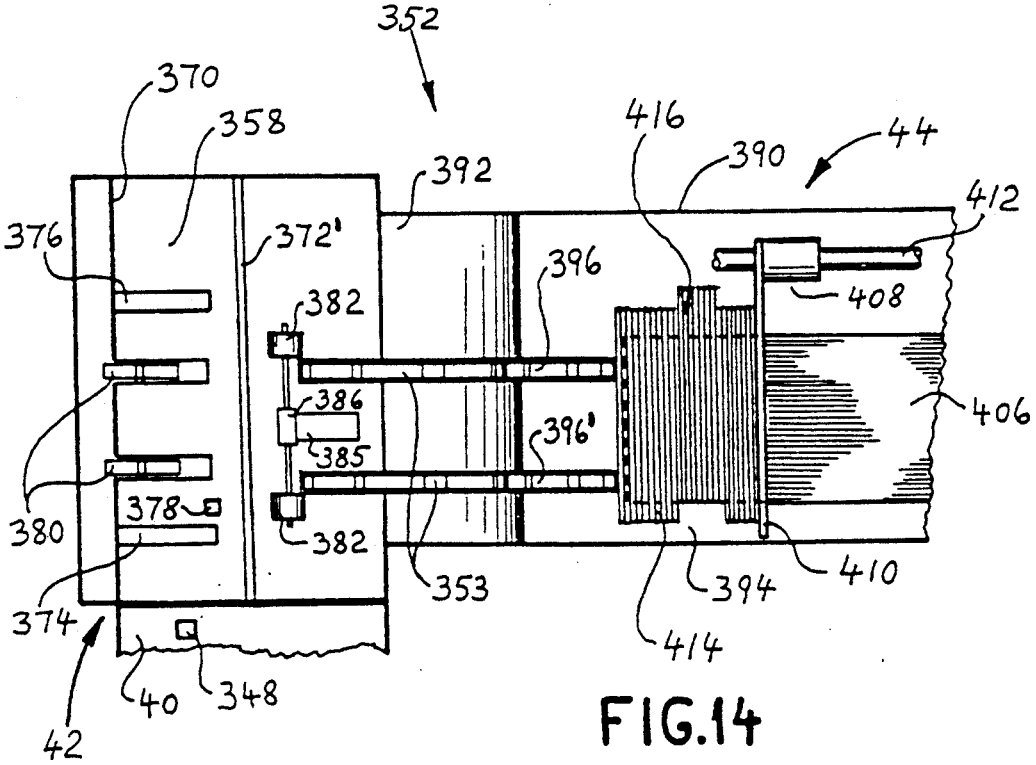
FIG. 14 is a schematic partial fragmented top view of the unit shown in FIG. 13.

Referring now to FIGS. 11–15, on-edge stacking-/diverter unit 42 is depicted therein. FIGS. 11, 12, and 14 include fragmental depictions of turnover module 40 (for instance, as indicated in FIG. 1) which delivers envelopes to on-edge stacking/diverter unit 42. It should be understood that, in alternate embodiments of the invention, turnover module 40 can be replaced by other system modules that can deliver envelopes to unit 42. In particular also, this reference to module 40 is intended to alternately also refer to postage meter module 49A, for instance in an arrangement as indicated in FIG. 1A.

On-edge stacking/diverter unit 42 comprises a diverter section 350 to selectively pass on or divert envelopes, a stacker section 352 for stacking of diverted envelopes and including a stacking spider 353, and accumulator 44 for accumulating stacked envelopes.

Particularly referring now to FIGS. 11 and 12, diverter section 350 comprises a base structure 354 (common also with stacker section 352), an upper level 365 for receiving, diverting, and passing on of envelopes delivered thereto, and a lower level 358 to which envelopes are diverted for stacking.

Upper level 356 comprises a plurality of conventional pressure rollers 360 that provide pressure onto envelopes against a drive roll 362 and a drive belt 364 which thusly convey envelopes upon upper level (to the right). Further comprised in the floor of upper level 356 is a selectively operable hinged divert gate 366 that is shown in its closed position flush with the floor of upper level 356 and whose open position is indicated by dashed lines. Additionally, the floor of upper level 356 comprises a photosensor 368 for sensing of envelopes leaving toward the right side to subsequent envelope handling equipment, a rear wall 370 and an adjustable aligner 372; the latter two serving for alignment of envelopes therebetween, being adjustable to different envelope widths. Aligner 372 is provided with a partial cutout above divert gate 366 to permit opening of the latter. Above the floor of lower level 358, in the vicinity of the hinge of gate 366, is disposed a guide strip 373 to guide downwardly diverted envelopes onto the floor. Guide strip 373 is, for example, of Teflon or other low-friction material to promote downwardly sliding deflection of envelopes along its lower surface.

Lower level 358 comprises selectably operable adjustable length-stops 374 and 376 that are ganged together for common positional shifts along rear wall 370 to provide selectable envelope offset in stacking. Further, lower level 358 comprises an adjustable aligner 372' that is ganged with aligner 372. Aligner 372' is spaced from the floor of lower level 358 for form an opening adequate to clear envelopes propelled therethrough. Further comprised in an beneath the floor of lower level 358 is a photosensor 378 for detection of envelopes diverted thereupon, a pair of rotatable paddles 380 mounted upon a common shaft that is borne beneath the floor of lower level 358, and an upper and a lower pair of rotating nip rolls 382 and 384, respectively, each pair being borne upon a separate shaft. One of the pair of nip rolls is motor-driven, so that a nipped envelope is transported toward stacking spider 353.

A curved arm 385 of resilient flat spring material is freely pivotably disposed in the envelope path between nip rolls 382, 384 and stacking spider 353, as indicated in FIGS. 13 and 14, so that an envelope propelled along this path is restrained from bouncing (and possibly misaligning) once it has left the nip of the rolls. Arm 385 is secured to a pivotable mount 386. Mount 386 is mounted within the structure of the lower level 358. Arm 385 is held in the position shown by its weight and allows an envelope to pass slidingly thereunder.

Paddles 380 are selectively commonly rotatable in increments of 180 degrees with respect to the position shown in FIG. 13 by a motor via a conventional solenoid-actuatable one-half revolution clutch in response to appropriate control signals. When rotated, ends of paddles 380 protrude and move through appropriate clearance slots in floor of lower level 358 so that their motion propels an envelope disposed thereupon into the nip between rolls 382 and 384. For example, an envelope 388 (shown in phantom lines in FIG. 11) falls from upper level 356 to lower level 358, having been diverted by gate 366. This envelope is then indicated as envelope 388' (in FIG. 13) subsequent to its diversion and disposed upon the floor of level 358. A subsequent selective operation of paddles 380 (clockwise) propels envelope 488' to the right.

Referring now particularly to FIGS. 13 and 14, stacker section 352 comprises a horizontally slidably adjustable table 390 that is partially borne in and upon base structure 354 in a telescoping manner, and stacking spider 353 which is borne in table 390 and which is motor-driven via a selectively energizable clutch in clockwise direction. Spider 353 included a timing disc revolving commonly therewith and a photosensor sensing the position of the disc (not shown here). As will be described hereinafter in more detail, stacking spider 353 is borne in table 390 in floating manner, being free to move for a short distance in a substantially horizontal plane away from accumulator 44. Stacking spider 353 is spring-loaded toward accumulator 44. Table 390 includes an upper surface 392 and a stacking surface 394. Upper surface 392 is disposed at substantially the same level as or slightly lower than the surface of the floor of lower level 358. Stacking surface 394 is disposed at a lower level than upper surface 392 and adjoins a downwardly curved extension thereof.

Stacking spider 353 further comprises a pair of parallel spider wheels 396 and 396' commonly mounted and driven by a shaft 398. Spider wheels are identical in shape, having disposed about their peripheries a plurality of equally spaced spider legs 400 of generally sawtooth-like shape in a trailing orientation in respect to their normal clockwise direction of rotation. Spaces between spider legs 400 are such that a stuffed envelope can easily be disposed therein, as indicated for example by envelope 402. Spacing between spider wheels 396 and 396' is somewhat less than the length of the shortest envelope that is required to be handled by the equipment. Slidable adjustment of table 390 is provided for adaptation of the equipment to different size envelopes, in particular to different widths and it is, therefore, ganged to the adjustment of aligners 372 and 372', as indicated by dotted lines of gang connection 404 (FIG. 13).

Accumulator 44 is substantially a conventional stack accumulator device that is customarily used to accumulate flat articles, such as documents, envelopes, and the like side-on-side in vertical orientation. Accumulator 44 is borne on table 390 and comprises a powered conveyor belt arrangement 406 having its upper surface disposed slightly above stacking surface 394. It comprises a back plate arrangement 408 that includes an L-shaped back plate 410 having permanent magnets 412 attached to its bottom surface for repositionable attachment seating upon the upper surface of the belt of belt arrangement 406. Back plate 410, in the manner of a "magnetic bookend", can be removed and replaced for instance for removal of an envelope stack. Alternately, other back plate arrangements of convention type can be used, as for instance a back plate slideably (with relatively high friction) and hingeably borne upon a rod suspended on a side above an accumulating stack (above belt arrangement 406). The latter arrangement allows upward hinging of the back plate about the rod for removal of stack 414. Powered conveyor belt arrangement 406 facilitates orderly accumulation of a stack by incrementally moving on-edge stacked envelopes in unison in response to increasing stack thickness detected by a photosensor. This photosensor detects horizontal movement of stacking spider 353 due to increase of stack thickness.

When only short stacks of envelopes are to be handled in accumulator 44, conveyor belt arrangement 406 need not be powered, but can be free-running (offering appropriate resistance). In this case, sensing of stack accumulation is not needed and stacking spider 353 need not be arranged in the indicated floating manner.

Envelope stack 414 has an offset portion 416 disposed therein to illustrate the result of the hereinabove described selectable envelope offset capability comprised in lower level 358. For instance, to distinguish a particular set of diverted envelopes (for example by specific zip codes), the indicates offset capability is provided so that offset portion 414 may be recognized and selectively handled subsequently to its accumulation.

Figure 15:
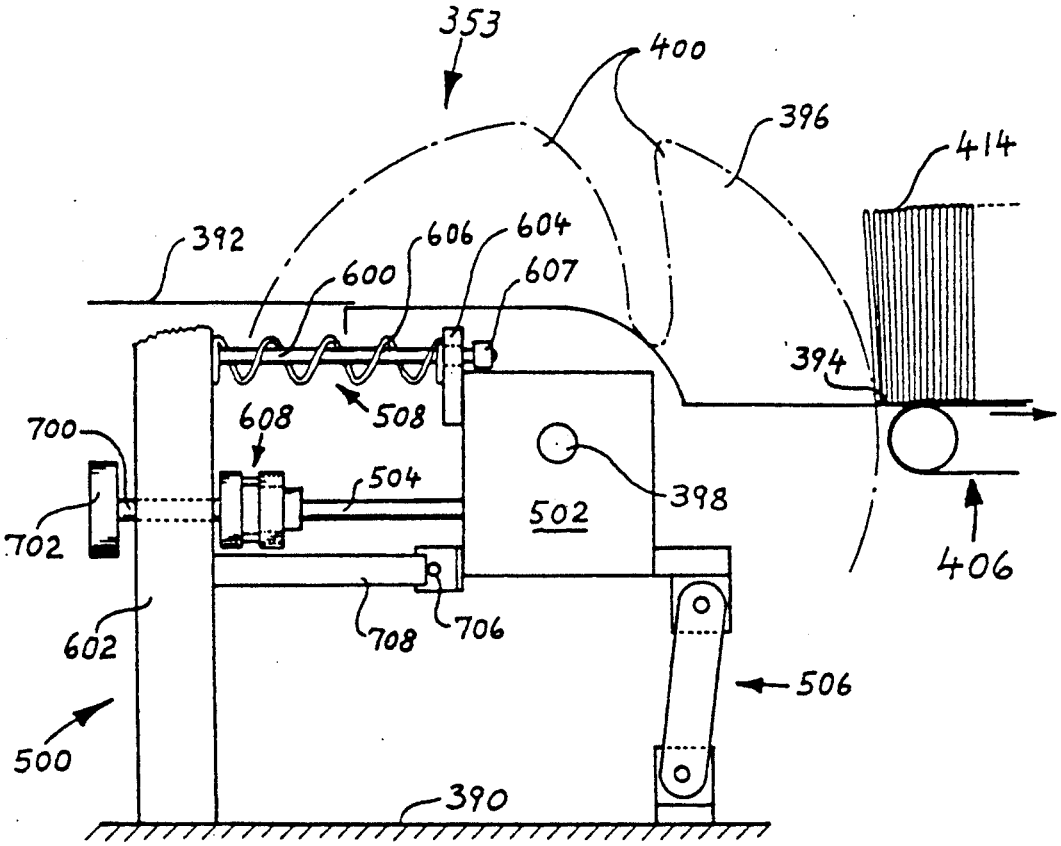

Referring now particularly to FIG. 15, the floating manner in which stacking spider 353 is borne in table 390 is provided by a floating drive suspension arrangement 500. Spider wheels 396 are borne on and revolved by shaft 398. Arrangement 500 serves to drive and suspend shaft 398 so that stacking spider 353 is free to move for a short distance in a substantially horizontal direction toward the left and away from stacking surface 394 (toward which it is spring loaded).

Arrangement 500 comprises a worm reducer gearbox 502. The output of gearbox 502 is provided via shaft 398. Gearbox 502, driven by an input shaft 504, is supported via rocker arm means 506 whose one end is securely mounted with table 390. Additionally, gearbox 502 is supported in spring-loaded manner by spring loading means 508. Means 508 comprises a guide rod 600 that is secured, at one end thereof, to a post 602. Post 602 is rigidly affixed to table 390. The free end of rod 600 extends through a clearance hole in a bracket 604 that is rigidly attached to or is a part of the housing of gearbox 502. A compression spring 606 is threaded over guide rod 600 and, in pre-compressed manner, extends between post 602 and bracket 604 and thusly forces gearbox 502 toward the right. A mechanical stop in form of a stop collar 607 limits the possible travel distance of gearbox 502 toward the right. Stop collar 607 is secured to the free end of rod 600 and contacts bracket 604 at the limit of floating travel of gearbox 502.

Input shaft 504 is coupled via a pin coupling 608 to drive axle 700. Axle 700 extends through and is borne by post 602 in an appropriate bearing therein. A drive pulley 702, that is attached to the end of axle 700, is driven via a belt (not shown here) by a drive mechanism. Pin coupling 608 couples the rotation of axle 700 to input shaft 504, while permitting axial displacement (as well as a small amount of angular misalignment) therebetween.

It will be understood that rocker arm means 506 comprises at least two parallel rocker arms or a unitary rocker arm having adequate bearing lengths and rigidity to provide the required support for gearbox 502. This support must avoid substantial angular and axial displacement of shaft 398; in other words, skewing and rocking motions of spider wheels 396 must be avoided.

With reference to FIGS. 11 through 15, in operation of on-edge stacking/diverter unit 42, envelopes are seriatim delivered thereto in horizontal orientation and in alignment substantially along rear wall 370 upon the floor of upper level 356. If divert gate 366 is in its closed position, envelopes are conveyed toward the right for delivery to farther equipment. If divert gate has been opened, for instance by a solenoid, an envelope is diverted to lower level 358, as indicated by envelope 388. Guide strip 373 aids in the proper diversion. Envelope 388 falls onto the floor of lower level 358, as indicated by envelope 388' (FIG. 13), in the region between length-stops 374 and 376 and between rear wall 370 and aligner 372'.

Subsequently actuated clockwise rotation of paddles 380 propels envelope 388' toward and into the nip between rolls 382, 384 and, thereby, into a space between spider legs 400. Once an envelope has settled in spider wheels 396 and is carried initially upwardly thereby, arm 385 pivots upwardly, being lifted by the envelope disposed thereunder, slides along and out of the way of the envelope, and thereafter pivot back by gravity. Moreover, the action of arm 385 ensures that a delivered envelope does not bounce or otherwise move out from its proper location between spider legs 400 during the initial upward movement.

Appropriate timing of actuation of paddles 380 to assure than an envelope is propelled into a space between legs 400 is obtained by the action of the timing disc and photosensor arrangement of stacking spider 353. Energization of the clutch to paddles 380 is inhibited at such times when a propelled envelope would impinge upon a spider leg 400.

Spider wheels 396, 396' carry envelopes to stacking surface 394 and deposit them edge-on. Additionally, trailing edges and tips of spider legs continue to push deposited envelopes side-on-side onto the accumulating envelope stack 414.

Referring now also particularly to FIG. 15, in response to increasing stack pressure, spider wheels 396 move back resiliently (to the left) by the action of the floating drive suspension arrangement 500, allowing stack 414 to increase in thickness. A photosensor 706 secured to the floating body of gearbox 502 is partially obstructed by a stationary flag 708. The drive of conveyor belt arrangement 406 is energized in response to sensing of flag 708 by photosensor 706, and belt arrangement 406 incrementally moves the accumulated stack 414 toward the right. Consequent stack pressure relief allows spider wheels 396 to follow. When flag 708 is no longer detected by photosensor 706, the drive of belt arrangement 406 is deenergized. As a result, stack pressure is maintained within appropriate limits and orderly stacking is provided, regardless of the thickness of an accumulating stack.

In general, various photosensors provide signals for tracking of handled envelopes and inserts throughout the apparatus assembly. Interdependent control of various actuations under supervision of main computer 50 (and subsidiary controls and microprocessors) is provided throughout the in-line rotary inserter device of the invention. The various sensors particularly also facilitate asynchronous operation in further handling of envelopes that have had inserts inserted therein. Whereas synchronous operation may be utilized, asynchronous handling capability is preferred in view of the advantages offered. It will be understood in this respect that transporting of inserts and envelopes to inserting station 32 is a substantially synchronous operation to the extend that appropriate timing of arrival of mutually associated envelopes and inserts at inserting station 32 is essential.

Referring now again to FIGS. 1 and 1A, main computer 50 is interconnected with subsystems and subunits, also including power supplies, drive motors, pumps and blowers, sensors, detectors, actuators, display stations, control stations, and other electrically operated and electrical signal-generating components either directly of via subsidiary or intermediate control and supervisory units. The latter can include microprocessors to automatically control and supervise the operation of individual units in preprogrammed manner under the overall control of computer 50. For example, sensing of malfunctions, damaged, defective or misaligned items, and consequent diversion and rejection thereof, as well as compensation therefor in subsequent operation, is automatically handled by main computer 50 in preprogrammed manner, as the computer tracks inserts and envelopes individually sequentially and associatively with their associated complementary counterparts.

Moreover, main computer 50 provides auxiliary system control functions, such as, for example, automatic start-up. (and shut-down) sequencing of power and particularly of motor power supplies for reducing power surges and consumption (and noise). In this respect, computer 50 controls selective powering-up of a plurality of pumps for air, vacuum, and water in appropriate sections in accordance with particular momentary demand, and computer 50 further controls automatic cycling of pumps, selective shut-down of motors consequent to timed inactivities, shut-down of malfunctioning subsystems, and the like. Individual malfunction display and reset control stations for individual inserter modules and other subsystems are located in the vicinity of corresponding units and are interconnected with computer 50. Whereas central overriding control by computer 50 is provided through display/control console 52, individual local malfunction display and reset stations are provided in appropriately interlocked manner for local operator convenience, to localize malfunctions, and to direct and assure local attention by operators in case of malfunctions.

In brief recapitulation of the general overall operation of the in-line rotary inserter device, inserts are fed from a plurality of inserter modules onto a moving pin conveyor whereupon one or more inserts are accumulated in insert stack packages that are conveyed to an inserting station. Envelopes are fed to the inserting station, are inserted therein with insert stack packages, and are transported farther through sealing and turnover modules. Sealed and turned-over envelopes are stacked in at least one accumulator. Prior to being stacked, sealed and turned-over envelopes can be conveyed through a postage meter module for appropriate metering (franking).

While the invention has been particularly shown and described with reference to preferred embodiments thereof, it will be understood by those skilled in the art that various changes and modifications in form and details may be made therein without departing from the spirit and scope of the invention.

The embodiments of the invention in which an exclusive property or privilege is claimed are defined as follows:

1. An in-line rotary inserter comprising:

an envelope handling system for processing of insert-filled envelopes;

an inserting station for insertion of inserts into envelopes and for delivering insert-filled envelopes to said envelope handling system;

conveying means for conveying inserts to said inserting station;

at least one rotary insert feeder module for dispensing inserts to said conveying means, said rotary insert feeder including means for thickness sensing of inserts;

an envelope feeding system for feeding of envelopes to said inserting station, said envelope feeding system including an envelope diverter for selective diversion of envelopes and a vacuum gripper drum for delivering envelopes to said inserting station; and a pre-programmable computer system including input and output means and at least one control and display unit, said computer system serving for control and supervision of in-concert operation of said envelope feeding system, said at least one rotary insert feeder module, said conveying means, said inserting station, and said envelope handling system, said computer system providing sequential and associative tracking of individual inserts and collated insert packs, envelopes, and insert-filled envelopes;

wherein said envelope handling system includes a vacuum belt transporter/diverter comprising a substantially horizontal surface and at least two parallel commonly driven endless belts having their uppermost surfaces slightly raised above said horizontal surface, said uppermost surfaces serving to receive thereupon insert-filled envelopes delivered thereto from said inserting station, said endless belts being oriented substantially orthogonally with respect to the direction of delivery thereto of insert-filled envelopes, said horizontal surface including a delivery region disposed in the area to which insert-filled envelopes are delivered, wherein said horizontal surface includes a plurality of vacuum openings disposed in said delivery region between said endless belts, said vacuum openings being supplied with vacuum to attract an insert-filled envelope and thereby increase friction with respect to said uppermost surfaces of said driven endless belts so that said belts transport insert-filled envelopes thereupon for further processing.

2. The in-line rotary inserter according to claim 1, wherein said vacuum gripper drum comprises first and second face discs each including a peripheral surface, said peripheral surface being operative for carrying of envelopes thereupon, said peripheral surface including a plurality of vacuum openings connected to a source of vacuum, said plurality of vacuum openings being operative in attracting and holding envelopes to said peripheral surface by the action of vacuum valved to said vacuum openings.

3. The in-line rotary inserter according to claim 1, wherein said envelope handling system comprises a turnover module, and wherein said turnover module comprises a belt and pulley system including at least first, second, third, and fourth pulleys, at least one of said pulleys being driven, said pulleys being disposed substantially in a common vertical plane, wherein said first and second pulleys define a first pulley pair and said third and fourth pulleys define a second pulley pair, said pulleys of each said pair being disposed proximally to and substantially above one another, wherein said pairs are spaced from each other, said pulley system including an endless flat belt disposed about said pulleys in resiliently tensioned manner in shape of a flattened figure 'eight' having a crossover portion, said crossover portion including two mutually contacting length portions of said flat belt twisted about one another by an angle of substantially one hundred and eighty degrees, said crossover portion being operative in nipping between said two length portions an envelope delivered to said turnover module and transporting the envelope therethrough while turning the envelope over by substantially one hundred and eighty degrees.

4. The in-line rotary inserter according to claim 3, wherein said endless flat belt includes two discrete surfaces, each said discrete surface having a seven hundred and twenty degree twist.

5. The in-line rotary inserter according to claim 1, wherein said envelope handling system comprises a sealing module, wherein said sealing module comprises a moistening section, a sealing section, and first and second driven conveyor belts for conveying therethrough of an open-flap insert-filled envelope that is delivered thereto for sealing in an orientation having its flap pointing substantially vertically downwardly, wherein said moistening section includes a spray nozzle for spraying of water spray onto the gummed region of an envelope flap as the envelope passes by said nozzle, said spray nozzle directing spray in a generally horizontal direction substantially transversally to the conveying motion of an envelope passing by, said spray nozzle being spaced from the envelope flap to facilitate development of a spray pattern prior to spray impact on the flap, and wherein said sealing section includes a flap closing guide, said flap closing guide including a curved portion that slideably engages the outer flap surface while an envelope is conveyed from said moistening section to said sealing section, said flap closing guide being operative in deflecting the envelope flap to its closed position, said sealing section including a plurality of sealing pressure rolls resiliently loaded onto said second driven conveyor belt so that an envelope with moistened and closed flap is nipped and thereby sealed between said rolls and said belt and is conveyed farther thereby.

6. The in-line rotary inserter according to claim 1, wherein said envelope handling system includes a sealing module, said sealing module comprising a moistening section, a sealing section and first and second driven conveyor belts for conveying therethrough of an open-flap insert-filled envelope that is delivered thereto for sealing in an orientation having its flap pointing substantially vertically downwardly, wherein said moistening section includes a spray nozzle for spraying of water spray onto the gummed region of an envelope flap as the envelope passes by said nozzle, said spray nozzle directing spray in a generally horizontal direction substantially transversely to the conveying motion of an envelope passing by, said spray nozzle being spaced from the envelope flap to facilitate development of a spray pattern prior to spray impact on the flap, and wherein said sealing section includes a flap closing guide, said flap closing guide including a curved portion that slideably engages the outer flap surface while an envelope is conveyed from said moistening section to said sealing section, said flap closing guide being operative in deflecting the envelope flap to its closed position, said sealing section including a plurality of sealing pressure rolls resiliently loaded onto said second driven conveyor belt so that an envelope with moistened and closed flap is nipped and thereby sealed between said rolls and said belt and is conveyed further thereby.

7. The in-line rotary inserter according to claim 1, wherein said vacuum gripper drum comprises first and second face discs each including a peripheral surface, said peripheral surface being operative for carrying of envelopes thereupon, said peripheral surface including a plurality of vacuum openings connected to a source of vacuum, said plurality of vacuum openings being operative in attracting and holding envelopes to said peripheral surface by the action of vacuum valved to said vacuum openings.

8. In an in-line rotary inserter, said inserter including an envelope handling system for processing of insert-filled envelopes, a turnover module comprised in said envelope handling system, said turnover module comprising a belt and pulley system including at least first, second, third, and fourth pulleys, at least one of said pulleys being driven, said pulleys being disposed substantially in a common vertical plane, wherein said first and second pulleys define a first pulley pair and said third and fourth pulleys define a second pulley pair, said pulleys of each said pair being disposed proximally to and substantially above one another, wherein said pairs are spaced from each other, said pulley system including an endless flat belt disposed about said pulleys in resiliently tensioned manner in shape of a flattened figure 'eight' having a crossover portion, said crossover portion including two mutually contacting length portions of said flat belt twisted about one another by an angle of substantially one hundred and eighty degrees, said crossover portion being operative in nipping between said two length portions an envelope delivered to said turnover module and transporting the envelope therethrough while turning the envelope over by substantially one hundred and eighty degrees.

9. In an in-line rotary inserter, the turnover module according to claim 8, wherein said endless flat belt includes two discrete surfaces, each said discrete surface having a seven hundred and twenty degree twist.

10. A method for operating inserter, including steps of:

handling and processing of insert-filled envelopes;

inserting of inserts into envelopes;

delivering insert-filled envelopes for said step of handling and processing;

conveying inserts for said step of inserting;

dispensing inserts for said step of conveying;

feeding envelopes for said step of inserting; and controlling and supervising in-concert operation of said steps of handling and processing, inserting, delivering, conveying, feeding, and dispensing by a preprogrammable computer system; characterized by that said handling and processing of insert-filled envelopes comprises the steps of:

receiving insert-filled envelopes upon at least two parallel commonly driven belts in a receiving region, said commonly driven belts being oriented substantially orthogonally to the direction of said step of delivering, said commonly driven belts having a plurality of vacuum openings disposed therebetween;

supplying vacuum to said vacuum openings and thereby attracting insert-filled envelopes received upon said commonly driven belts thereto; and transporting insert-filled envelopes upon said commonly driven belts for further processing.

11. The method according to claim 10, wherein said step of feeding envelopes includes a step of carrying envelopes upon the periphery of a gripper drum, said step of carrying characterized by steps of:

valving vacuum to openings in the periphery of said gripper drum;

attracting envelopes to the periphery of said gripper drum by virtue of said step of valving vacuum;

delivering envelopes for said step of inserting; and, discontinuing vacuum to said openings in the periphery of said gripper drum and thereby releasing envelopes from the periphery of said gripper drum.

12. The method of claim 10, characterized by that said step of feeding envelopes includes a step of selectively diverting envelopes from their delivery path prior to said step of inserting.

13. The method of claim 10, characterized by that said step of feeding envelopes includes steps of:

carrying envelopes upon the periphery of a vacuum gripper drum;

valving vacuum to openings in the periphery of said vacuum gripper drum;

attracting envelopes to the periphery of said vacuum gripper drum by virtue of said step of valving vacuum;

delivering envelopes for said step of inserting; and discontinuing vacuum to said openings in the periphery of said vacuum gripper drum and thereby releasing envelopes from the periphery of said vacuum gripper drum.

14. The method of claim 10, wherein said step of handling and processing of insert-filled envelopes includes a step of turning over of envelopes, said step of turning over characterized by steps of:

driving an endless flat belt disposed in a pulley system having at least four pulleys disposed substantially in a common plane, said pulleys being arranged in two pairs, said two pairs being spaced from one another, said pulleys of each pair being disposed vicinally to one another;

carrying said endless flat belt upon and about said at least four pulleys in resiliently tensioned manner in the shape of a flattened figure 'eight' including a belt crossover portion, said belt crossover portion including two mutually contacting length portions of said endless flat belt twisted about one another by an angle of substantially one hundred and eighty degrees;

delivering an envelope to a nip ingress between said two mutually contacting length portions;

nipping the envelope between said two mutually contacting length portions; and transporting and turning over the envelope in said belt crossover portion.

15. The method of claim 14 characterized by that said endless flat belt consists of a length of flat belting joined end-to-end, wherein said length of endless flat belting is provided with a seven hundred and twenty degree twist along its length.

16. The method of claim 10, wherein said step of handling and processing insert-filled envelopes includes a step of envelope sealing, said step of envelope sealing characterized by steps of:

conveying envelopes through a moistening section, said envelopes having their open flaps pointed substantially vertically downwardly;

spraying gummed areas of envelope flaps by water spray nozzle means and thereby moistening said areas while envelopes are conveyed through said moistening section past said water spray nozzle means;

deflecting and guiding moistened envelope flaps by a flap closing guide to closed position while said envelopes are being conveyed to a sealing section; and sealing envelope flaps closed in said step of deflecting and guiding while envelopes are conveyed between a conveyor belt and a plurality of resilient sealing rolls.

17. A method for handling and processing of insert-filled envelopes including a step of transporting/diverting characterized by steps of:

receiving insert-filled envelopes upon at least two parallel commonly driven belts in a receiving region, said commonly driven belts being oriented substantially orthogonally to the direction of said step of delivering, said commonly driven belts having a plurality of vacuum openings disposed therebetween;

supplying vacuum to said vacuum openings and thereby attracting insert-filled envelopes received upon said commonly driven belts thereto; and transporting insert-filled envelopes upon said commonly driven belts for further processing.

18. In an in-line rotary inserter, said inserter including an envelope handling system for processing of insert-filled envelopes, a vacuum belt transporter/diverter comprised in said envelope handling system, said vacuum belt transporter/diverter comprising a substantially horizontal surface and at least two parallel commonly driven endless belts having their uppermost surfaces slightly raised above said horizontal surface, said uppermost surfaces serving to receive thereupon insert-filled envelopes delivered thereto from said inserting station, said endless belts being oriented substantially orthogonally with respect to the direction of delivery thereto of insert-filled envelopes, said horizontal surface including a delivery region disposed in the area to which insert-filled envelopes are delivered, wherein said horizontal surface includes a plurality of vacuum openings disposed in said delivery region between said endless belts, said vacuum openings being supplied with vacuum to attract an insert-filled envelope and thereby increase friction with respect to said uppermost surfaces of said driven endless belts so that said belts transport insert-filled envelopes thereupon for further processing.

19. A method of handling and processing of envelopes including a step of turning over of envelopes, characterized by steps of:

driving an endless flat belt disposed in a pulley system having at least four pulleys disposed substantially in a common plane, said pulleys being arranged in two pairs, said two pairs being spaced from one another, said pulleys of each pair being disposed vicinally to one another;

carrying said endless flat belt upon and about said at least four pulleys in resiliently tensioned manner in the shape of a flattened figure 'eight' including a belt crossover portion, said belt crossover portion including two mutually contacting length portions of said endless flat belt twisted about one another by an angle of substantially one hundred and eighty degrees;

delivering an envelope to a nip ingress between said two mutually contacting length portions;

nipping the envelope between said two mutually contacting length portions; and transporting and turning over the envelope in said belt crossover portion.

20. The method of claim 19 characterized by that said endless flat belt consists of a length of flat belting joined end-to-end, wherein said length of endless flat belting is provided with a seven hundred and twenty degree twist along its length.

21. A method of handling and processing insert-filled envelopes including a step of envelope sealing, said step of envelope sealing characterized by steps of:

conveying envelopes through a moistening section, said envelopes having their open flaps pointed substantially vertically downwardly;

spraying gummed areas of envelope flaps by water spray nozzle means and thereby moistening said areas while envelopes are conveyed through said moistening section past said water spray nozzle means;

deflecting and guiding moistened envelope flaps by a flap closing guide to closed position while said envelopes are being conveyed to a sealing section; and sealing envelope flaps closed in said step of deflecting and guiding while envelopes are conveyed between a conveyor belt and a plurality of resilient sealing rolls.

* * * * *